US010825420B2

(12) United States Patent
Park et al.

(10) Patent No.: US 10,825,420 B2
(45) Date of Patent: Nov. 3, 2020

(54) IMAGE DISPLAY APPARATUS

(71) Applicant: LG ELECTRONICS INC., Seoul (KR)

(72) Inventors: Jinsup Park, Seoul (KR); Byunghyun An, Seoul (KR); Kanghyun Yoon, Seoul (KR); Inhwan Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/926,691

(22) Filed: Mar. 20, 2018

(65) Prior Publication Data

US 2018/0268781 A1 Sep. 20, 2018

(30) Foreign Application Priority Data

Mar. 20, 2017 (KR) ..... 10-2017-0034842

(51) Int. Cl.
*G09G 5/10* (2006.01)
*G09G 3/34* (2006.01)

(52) U.S. Cl.
CPC ..... *G09G 5/10* (2013.01); *G09G 3/342* (2013.01); *G09G 2320/02* (2013.01); *G09G 2320/0238* (2013.01); *G09G 2320/0626* (2013.01); *G09G 2320/0686* (2013.01); *G09G 2360/144* (2013.01); *G09G 2360/16* (2013.01)

(58) Field of Classification Search
CPC ..... G09G 5/10; G09G 3/342; G09G 2320/02; G09G 2320/0626; G09G 2320/0686; G09G 2360/144; G09G 2360/16
See application file for complete search history.

(56) References Cited

U.S. PATENT DOCUMENTS

2003/0230991 A1* 12/2003 Muthu ..... G09G 3/3413 315/307
2005/0058450 A1* 3/2005 Yamamoto ..... G01J 1/32 398/25
2010/0253696 A1* 10/2010 Choi ..... G09G 3/3426 345/589
2010/0265228 A1* 10/2010 Kimura ..... G09G 3/3233 345/207

(Continued)

FOREIGN PATENT DOCUMENTS

KR 2390871 A2 11/2011
KR 10-2016-0029553 A 3/2016

*Primary Examiner* — Kent W Chang
*Assistant Examiner* — Sujit Shah
(74) *Attorney, Agent, or Firm* — Birch, Stewart, Kolasch & Birch, LLP

(57) ABSTRACT

An image display apparatus is disclosed. The image display apparatus includes a display panel, an illuminance sensor to sense an ambient illuminance of the display panel, a plurality of light sources disposed in an edge region of a back surface of the display panel to output light, a plurality of switching elements to switch the light sources, and a processor to control the switching elements, wherein, when a difference in local dimming data of an input image between adjacent first and second regions is above a first reference value, the processor controls driving times of at least some of the switching elements to decrease a difference in illuminance between the first region and the second region, based on the illuminance sensed by the illuminance sensor.

19 Claims, 20 Drawing Sheets

(56) References Cited

U.S. PATENT DOCUMENTS

| | | | | |
|---|---|---|---|---|
| 2011/0316829 | A1* | 12/2011 | Oka | G09G 3/3426 345/207 |
| 2012/0105505 | A1* | 5/2012 | Wei | G09G 3/3426 345/690 |
| 2012/0139885 | A1* | 6/2012 | Iwasa | G09G 3/3426 345/207 |
| 2014/0055505 | A1* | 2/2014 | Ikeda | G09G 3/22 345/690 |
| 2014/0160181 | A1* | 6/2014 | Takeda | G09G 3/2007 345/690 |
| 2016/0035069 | A1* | 2/2016 | Min | G06T 5/007 382/266 |
| 2016/0379575 | A1* | 12/2016 | Kawai | G09G 3/3426 345/694 |

* cited by examiner

FIG. 13B

| Bit 1 (Duty Select 1) | Bit 2 (Duty Select 2) | Gain |
|---|---|---|
| 0 | 0 | Gain a |
| 0 | 1 | Gain b |
| 1 | 0 | Gain c |
| 1 | 1 | Gain d |

IMAGE DISPLAY APPARATUS

CROSS-REFERENCE TO RELATED APPLICATION

This application claims the priority benefit of Korean Patent Application No. 10-2017-0034842, filed on Mar. 20, 2017 in the Korean Intellectual Property Office, the disclosure of which is incorporated herein by reference.

BACKGROUND OF THE INVENTION

1. Field of the Invention

The present invention relates to an image display apparatus and, more particularly, to an image display apparatus capable of reducing a halo phenomenon in displaying images.

2. Description of the Related Art

Digital broadcasting refers to broadcasting that transmits digital images and audio signals. Compared to analog broadcasting, digital broadcasting is robust to external noise and thus suffers less data loss. In addition, digital broadcasting is advantageous for error correction and provides high definition and clear images. Further, digital broadcasting enables bidirectional services unlike analog broadcasting.

Meanwhile, according to demands of a user who desires to view a clear screen, resolution of an image display apparatus tends to increase and thus an image display apparatus having higher resolution has been developed.

SUMMARY OF THE INVENTION

Therefore, the present invention has been made in view of the above problems, and it is an object of the present invention to provide an image display apparatus capable of reducing a halo phenomenon in displaying images.

It is another object of the present invention to provide an image display apparatus capable of reducing a halo phenomenon while displaying an image of a high dynamic range.

In accordance with an aspect of the present invention, the above and other objects can be accomplished by the provision of an image display apparatus including a display panel, an illuminance sensor to sense an ambient illuminance of the display panel, a plurality of light sources disposed in an edge region of a back surface of the display panel to output light, a plurality of switching elements to switch the light sources, and a processor to control the switching elements, wherein, when a difference in local dimming data of an input image between adjacent first and second regions is above a first reference value, the processor controls driving times of at least some of the switching elements to decrease a difference in illuminance between the first region and the second region, based on the illuminance sensed by the illuminance sensor.

In accordance with another aspect of the present invention, there is provided an image display apparatus including a display panel, an illuminance sensor to sense an ambient illuminance of the display panel, a plurality of light sources disposed in an edge region of a back surface of the display panel to output light, and a processor to control the light sources, wherein the processor controls driving times of the light sources to be variable, based on the sensed illuminance.

In accordance with a further aspect of the present invention, there is provided an image display apparatus including a display panel, an illuminance sensor to sense an ambient illuminance of the display panel, a plurality of light sources disposed in an edge region of a back surface of the display panel to output light, and a processor to control the light sources, wherein, when a difference in local dimming data of an input image between adjacent first and second regions is above a first reference value, the processor controls driving times of at least some of the light sources to decrease a difference in illuminance between the first region and the second region, based on the illuminance sensed by the illuminance sensor.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Reference will now be made in detail to the preferred embodiments of the present invention, examples of which are illustrated in the accompanying drawings.

The suffixes "module" and "unit" in elements used in description below are given only in consideration of ease in preparation of the specification and do not have specific meanings or functions. Therefore, the suffixes "module" and "unit" may be used interchangeably.

Figure 1:
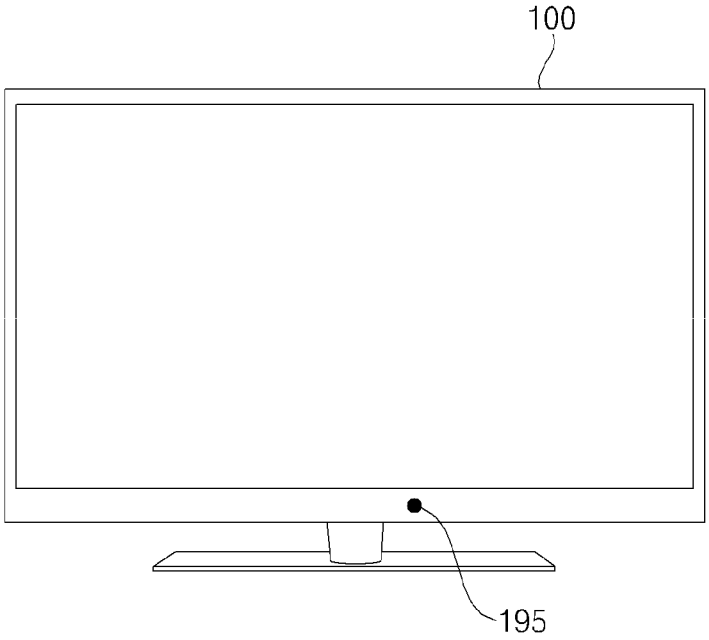
FIG. 1 is a view illustrating an image display apparatus according to an embodiment of the present invention.

FIG. 1 illustrates an outer appearance of an image display apparatus according to an embodiment of the present invention.

Figure 2:
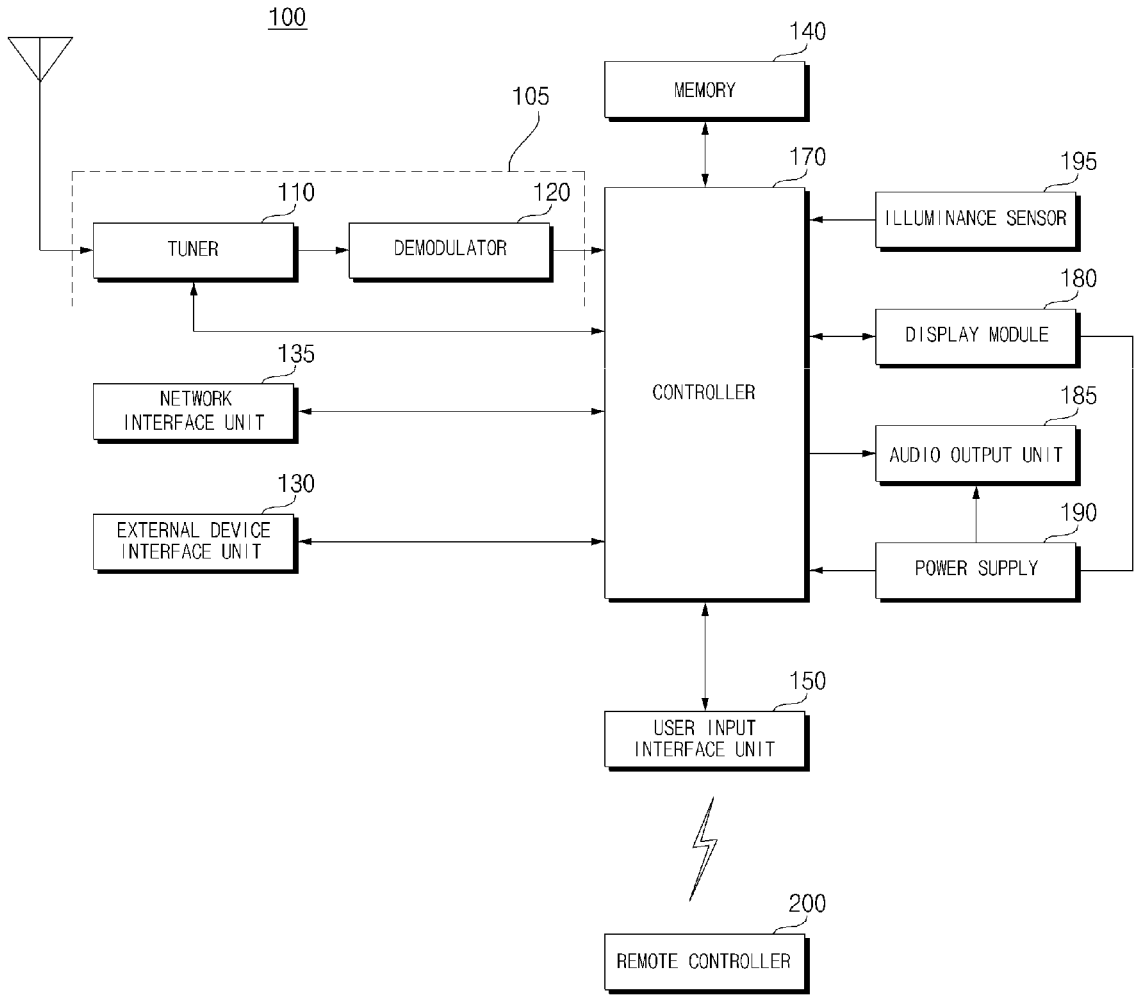
FIG. 2 is a block illustrating an internal configuration of an image display apparatus according to an embodiment of the present invention.

Referring to FIG. 1, an image display appearance 100 according to an embodiment of the present invention may include a display module (180 of in FIG. 2), a controller (170 of in FIG. 2) for performing a control operation to display images on the display module (180 of FIG. 2), and a power supply (190 of FIG. 2) for supplying power to the display module (180 of FIG. 2).

Meanwhile, as resolution of the image display apparatus 100 increases up to high definition (HD), full HD, ultra-high definition (UHD), etc., various schemes for displaying a high-definition image have been studied.

If the display module (180 of FIG. 2) is disposed in an edge region of the back surface of the display panel 210 and includes a plurality of light sources, a halo phenomenon in which light of the light sources leaks may occur around a lower edge due to the difference in illuminance of an input image.

Particularly, since the difference in an image between a bright region and a dark region is big in displaying an image of a high dynamic range, the halo phenomenon in which light of the light sources leaks may more frequently occur.

Accordingly, the present invention proposes a method of reducing the halo phenomenon.

To this end, an image display apparatus 100 according to an embodiment of the present invention includes a display panel (210 of FIG. 2 (? 210 of FIG. 7)), an illuminance sensor 195 to sense an ambient illuminance of the display panel (210 of FIG. 2 (? 210 of FIG. 7)), a plurality of light sources (252-1 to 252-6 of FIG. 7) disposed in an edge region of a back surface of the display panel (210 of FIG. 2) to output light, a plurality of switching elements (Sa1 to Sa6 of FIG. 8) to switch the light sources (252-1 to 252-6 of FIG. 7), and a processor (1130 of FIG. 8) to control the switching elements (Sa1 to Sa6 of FIG. 8), wherein, when a difference in local dimming data of an input image between adjacent first and second regions is above a first reference value, the processor (1130 of FIG. 8) controls driving times of at least some of the switching elements to decrease a difference in illuminance between the first region and the second region, based on the illuminance sensed by the illuminance sensor 195, thereby reducing the halo phenomenon in displaying images.

Particularly, the halo phenomenon generated between the first region and the second region can be reduced.

Meanwhile, as resolution of the image display apparatus 100 increases up to HD, full HD, UHD, 4K, or 8K, the halo phenomenon there may be a high probability of occurrence of the halo phenomenon.

Particularly, the halo phenomenon can be reduced while an image of a high dynamic range is displayed.

When the difference in local dimming data of an input image between the first and second regions is above the first reference value and when the illuminance sensed by the illuminance sensor 195 is less than a second reference value, the processor controls the driving times of the at least some of the switching elements (Sa1 to Sa6 of FIG. 8) to decrease the difference in illuminance between the first region and the second region, based on the sensed illuminance, thereby reducing the halo phenomenon which frequently occurs in a low illuminance state.

The processor controls the driving times of the at least some of the switching elements (Sa1 to Sa6 of FIG. 8) to be increased, as the sensed illuminance decreases, thereby properly reducing the halo phenomenon in displaying images.

The processor controls duties of switching control signals applied to the switching elements (Sa1 to Sa6 of FIG. 8) to be increased, as the sensed illuminance decreases, thereby reducing a halo phenomenon in displaying images.

Meanwhile, an image display 100 apparatus according to another embodiment of the present invention includes a display panel (210 of FIG. 2), an illuminance sensor 195 to sense an ambient illuminance of the display panel (210 of FIG. 2), a plurality of light sources (252-1 to 252-6 of FIG. 7) disposed in an edge region of a back surface of the display panel (210 of FIG. 2) to output light, and a processor (1130 of FIG. 8) to control the light sources, wherein the processor (1130 of FIG. 8) controls driving times of the light sources to be variable, based on the sensed illuminance, thereby reducing a halo phenomenon in displaying images.

Meanwhile, an image display apparatus 100 according to a further embodiment of the present invention includes a display panel (210 of FIG. 2), an illuminance sensor 195 to sense an ambient illuminance of the display panel (210 of FIG. 2), a plurality of light sources (252-1 to 252-6 of FIG. 7) disposed in an edge region of a back surface of the display panel to output light, and a processor (1130 of FIG. 8) to control the light sources, wherein, when a difference in local dimming data of an input image between adjacent first and second regions is above a first reference value, the processor (1130 of FIG. 8) controls driving times of at least some of the light sources (252-1 to 252-6 of FIG. 7) to decrease a difference in illuminance between the first region and the second region, based on the illuminance sensed by the illuminance sensor, thereby reducing a halo phenomenon in displaying images.

A method of reducing a halo phenomenon in displaying images in the above-described image display apparatus will be described later in detail with reference to FIG. 9A and subsequent drawings.

FIG. 2 is a block illustrating an internal configuration of an image display apparatus according to an embodiment of the present invention.

Referring to FIG. 2, the image display apparatus 100 according to an embodiment of the present invention may include a broadcast receiver 105, an external device interface unit 130, a memory 140, a user input interface unit 150, a sensor unit (not shown), a controller 170, a display module 180, an audio output unit 185, a power supply 190, and an illuminance sensor 195.

The broadcast receiver 105 may include a tuner 110, a demodulator 120, and a network interface unit 135. As needed, the broadcast receiver 105 may be designed not to include the network interface unit 135 while including the tuner 110 and the demodulator 120. In contrast, the broadcast receiver 105 may include only the network interface unit 135 and does not include the tuner 110 and the demodulator 120.

Unlike FIG. 2, the broadcast receiver 105 may include the external device interface unit 130. For example, a broadcast signal generated by a set-top box (not shown) may be received through the external device interface unit 130.

The tuner 110 selects a radio frequency (RF) broadcast signal corresponding to a channel selected by a user or all prestored channels from among RF broadcast signals received through an antenna 50 In addition, the tuner 110 converts the selected RF broadcast signal into an intermediate frequency (IF) signal, a baseband image, or an audio signal.

For example, if the selected RF broadcast signal is a digital broadcast signal, the tuner 110 converts the digital broadcast signal into a digital intermediate frequency (DIF) signal. If the selected RF broadcast signal is an analog broadcast signal, the tuner 110 converts the analog broadcast signal into an analog baseband image or an audio signal (composite video baseband signal (CVBS)/sound IF (SIF)). That is, the tuner 110 may process a digital broadcast signal or an analog broadcast signal. The analog baseband image or audio signal (CVBS/SIF) output from the tuner 110 may be directly input to the controller 170.

The tuner 110 may sequentially select RF broadcast signals for all broadcast channels stored through a channel memorization function from among RF broadcast signals received through the antenna and convert the same into an IF signal, a baseband image, or an audio signal.

Meanwhile, a plurality of tuners 110 may be provided in order to receive broadcast signals of a plurality of channels. Alternatively, a single tuner to simultaneously receive broadcast signals of a plurality of channels may be provided.

The demodulator 120 receives and demodulates the DIF signal converted by the tuner 110.

After performing demodulation and channel decoding, the demodulator 120 may output a transport stream (TS) signal. Herein, the stream signal may be a signal obtained by multiplexing an image signal, an audio signal, and a data signal.

The TS signal output from the demodulator 120 may be input to the controller 170. After performing demultiplexing and image/audio signal processing, the controller 170 outputs an image to the display module 180 and audio to the audio output unit 185.

The external device interface unit 130 may transmit or receive data to or from an external device connected thereto. To this end, the external device interface unit 130 may include an audio/video (A/V) input/output unit (not shown) or a wireless communication unit (not shown).

The external device interface unit 130 may be connected to external devices such as a digital versatile disc (DVD) player, a Blu-ray player, a game console, a camera, a camcorder, a (notebook) computer, and a set-top box in a wired/wireless manner and perform input/output operations with external devices.

The A/V input/output unit may receive image and audio signals from an external device. The wireless communication unit may perform short-range wireless communication with other electronic devices.

The network interface unit 135 provides an interface for connecting the image display apparatus 100 with a wired/wireless network including the Internet. For example, the network interface unit 135 may receive content or data provided by an Internet or content provider or a network operator over a network.

The memory 140 may store programs for processing and control of signals in the controller 170 and also store a signal-processed image, audio, or data signal.

The memory 140 may function to temporarily store an image signal, an audio signal, or a data signal input through the external device interface unit 130. In addition, the memory 140 may store information about a predetermined broadcast channel through the channel memorization function such as a channel map.

While an embodiment in which the memory 140 is provided separately from the controller 170 is illustrated in FIG. 2, embodiments of the present invention are not limited thereto. The memory 140 may be included in the controller 170.

The user input interface unit 150 may transmit a signal input by a user to the controller 170 or transmit a signal from the controller 170 to the user.

For example, the user input interface unit 150 may transmit/receive user input signals such as power on/off, channel selection, and screen window setting to/from the remote controller 200 or transmit user input signals input through local keys (not shown) such as a power key, a channel key, a volume key, or a setting key to the controller 170. The user input interface unit 150 may transmit user input signals input through a sensor unit (not shown) to sense gesture of the user to the controller 170 or transmit a signal from the controller 170 to the sensor unit (not shown).

The controller 170 may demultiplex the TS signal input through the tuner 110, the demodulator 120, or the external device interface unit 130 or process the demultiplexed signal to generate a signal for outputting an image or audio.

The image signal processed by the controller 170 may be input to the display module 180 such that an image corresponding to the image signal may be displayed on the display. In addition, the image signal processed by the controller 170 may be input to an external output device through the external device interface unit 130.

The audio signal processed by the controller 170 may be output to the audio output unit 185 in the form of sound. In addition, the audio signal processed by the controller 170 may be input to an external output device through the external device interface unit 130.

Although not illustrated in FIG. 2, the controller 170 may include a demultiplexer and an image processor, which will be described with reference to FIG. 3 later.

Additionally, the controller 170 may control an overall operation of the image display apparatus 100. For example, the controller 170 may control the tuner 110 to tune to an RF broadcast corresponding to a channel selected by the user or a prestored channel.

The controller 170 may control the image display apparatus 100 according to a user command input through the user input interface unit 150 or according to an internal program.

The controller 170 may control the display module 180 to display an image. Herein, the image displayed on the display module 180 may be a still image, a moving image, a 2D image, or a 3D image.

The controller 170 may recognize the location of the user based on an image captured by a capture unit (not shown). For example, the controller 170 may recognize the distance between the user and the image display apparatus 100 (i.e., a z-axis coordinate). Additionally, the controller 170 may recognize an x-axis coordinate and y-axis coordinate in the display module 180, corresponding to the location of the user.

Although not illustrated in FIG. 2, the image display apparatus 100 may further include a channel browsing processing unit for generating a thumbnail image corresponding to a channel signal or an external input signal. The channel browsing processing unit may receive a TS signal output from the demodulator 120 or a TS signal output from the external device interface unit 130, extract an image from the received TS signal, and generate a thumbnail image. The generated thumbnail image may be TS-decoded together with a decoded image and then input to the controller 170. The controller 170 may display a thumbnail list including a plurality of thumbnail images on the display module 180 using received thumbnail images.

The thumbnail list may be displayed in a brief viewing manner in which the thumbnail list is displayed in a portion of the display module 180 on which an image is being displayed or in a full viewing manner in which the thumbnail list is displayed over most of the display module 180. Thumbnail images in the thumbnail list may be sequentially updated.

The display module 180 generates drive signals by converting an image signal, a data signal, an on-screen display (OSD) signal, and a control signal processed by the controller 170 or an image signal, a data signal, and a control signal received from the external device interface unit 130.

The display module 180 may be a liquid crystal display (LCD), an organic light emitting diode (OLED) display, a flexible display, or a 3D display.

The display module 180 may be composed of a touch-screen and may function as an input device as well as an output device.

The audio output unit 185 receives an audio signal processed by the controller 170 and outputs audio.

A capture unit (not shown) captures an image of the user. The capture unit (not shown) may be implemented using one camera. However, embodiments of the present invention are not limited thereto and the capture unit (not shown) may be implemented using a plurality of cameras. The capture unit (not shown) may be buried in the upper portion of the display module 180 of the image display apparatus 100 or may be separately disposed. Information about the image captured by the capture unit (not shown) may be input to the controller 170.

The controller 170 may sense user gestures based on the image captured by the capture unit (not shown), the signal sensed by the sensor unit (not shown), or a combination thereof.

The power supply 190 supplies power to all parts of the image display apparatus 100. In particular, the power supply 190 may supply power to the controller 170, which may be implemented in the form of a system-on-chip (SOC), the display module 180 for displaying images, and the audio output unit 185 for outputting audio signals.

Specifically, the power supply 190 may include a converter for converting alternating current (AC) power into direct current (DC) power and a DC-DC converter for changing the level of the DC power.

The illuminance sensor 195 may sense illuminance of the periphery of the image display apparatus 100, particularly, the periphery of the display module 180. Information about the sensed illuminance may be input to the controller.

The remote controller 200 transmits a user input signal to the user input interface unit 150. To this end, the remote controller 200 may use Bluetooth, RF communication, infrared (IR) communication, ultra-wideband (UWB), or ZigBee. In addition, the remote controller 200 may receive an image signal, an audio signal, or a data signal from the user input interface unit 150 and then display or audibly output the received signal.

The image display apparatus 100 may be a fixed or mobile digital broadcast receiver capable of receiving a digital broadcast.

The image display apparatus 100 illustrated in FIG. 2 is a block diagram according to an embodiment of the present invention. Some of the constituents of the image display apparatus illustrated in the diagram may be combined or omitted or other constituents may be added thereto, according to specifications of the image display apparatus 100 as actually implemented. That is, two or more constituents of the image display apparatus 100 may be combined into one constituent or one constituent thereof may be subdivided into two or more constituents, as needed. In addition, a function performed in each block is simply illustrative and specific operations or units of the block do not limit the scope of the present invention.

Meanwhile, the image display apparatus 100 may not include the tuner 110 and the demodulator 120 as opposed to FIG. 2. Instead, the image display apparatus 100 may receive and reproduce image content through the network interface unit 135 or the external device interface 130.

The image display apparatus 100 is an exemplary image signal processing apparatus for processing signals of images stored therein or signals of input images. Another example of the image signal processing apparatus may be the above-described set-top box, DVD player, Blu-ray player, game console, or computer except for the display module 180 and the audio output unit 185 illustrated in FIG. 2.

Figure 3:
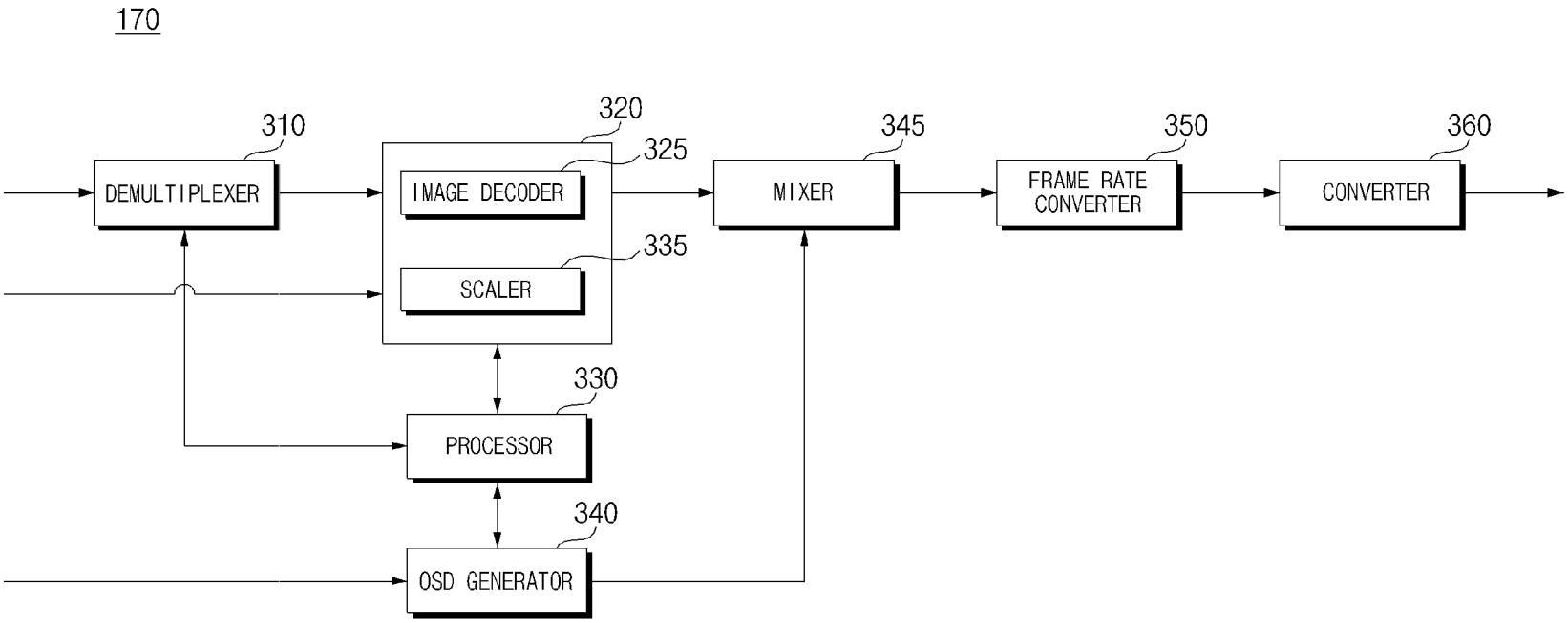
FIG. 3 is a block diagram illustrating an internal configuration of a controller illustrated in FIG. 2.

FIG. 3 is a block diagram illustrating an internal configuration of the controller illustrated in FIG. 2.

Referring to FIG. 3, the controller 170 according to an embodiment of the present invention may include a demultiplexer 310, an image processor 320, a processor 330, an OSD generator 340, a mixer 345, a frame rate converter 350, and a formatter 360. The controller 170 may further include an audio processor (not shown) and a data processor (not shown).

The demultiplexer 310 demultiplexes an input TS signal. For example, when an MPEG-2 TS signal is input, the demultiplexer 310 may demultiplex the MPEG-2 TS signal into an image signal, an audio signal, and a data signal. Herein, the TS signal input to the demultiplexer 310 may be a TS signal output from the tuner 110, the demodulator 120, or the external device interface unit 130.

The image processor 320 may perform image processing on the demultiplexed image signal. To this end, the image processing unit 320 may include an image decoder 325 and a scaler 335.

The image decoder 325 decodes the demultiplexed image signal and the scaler 335 scales the resolution of the decoded image signal such that the image signal can be output through the display module 180.

The image decoder 325 may include various types of decoders.

The processor 330 may control overall operation of the image display apparatus 100 or the controller 170. For example, the processor 330 may control the tuner 110 to tune to an RF broadcast corresponding to a channel selected by the user or a prestored channel.

In addition, the processor 330 may control the image display apparatus 100 according to a user command input through the user input interface unit 150 or according to an internal program.

The processor 330 may control data transmission to the network interface unit 135 or the external device interface unit 130.

The processor 330 may control operations of the demultiplexer 310, image processing unit 320 and OSD generator 340 in the controller 170.

The OSD generator 340 generates an OSD signal autonomously or according to a user input signal. For example, the OSD generator 340 may generate a signal for displaying a variety of information in the form of graphics or text on the screen of the display module 180 based on a user input signal. The generated OSD signal may include a variety of data such as a user interface screen, various menu screens, a widget, and an icon of the image display apparatus 100. The generated OSD signal may also include a 2D object or a 3D object.

The OSD generator 340 may generate a pointer which can be displayed on the display module, based on a pointing signal input from the remote controller 200. In particular, the pointer may be generated by a pointing signal processor (not shown) and the OSD generator 240 may include the pointing signal generator (not shown). Obviously, it is possible to provide the pointing signal processor (not shown) separately from the OSD generator 240.

The mixer 345 may mix the OSD signal generated by the OSD generator 340 with the image signal decoded by the image processing unit 320.

The frame rate converter (FRC) 350 may convert the frame rate of an input image. The FRC 350 may also directly output the input image without frame rate conversion.

The formatter 360 may arrange a left-eye image frame and right-eye image frame of the 3D image produced through frame rate conversion. The formatter 360 may output a synchronization signal Vsync to open a left-eye glass or right-eye glass of a 3D viewing apparatus (not shown).

An audio processor (not shown) in the controller 170 may process the demultiplexed audio signal. To this end, the audio processor (not shown) may include various decoders.

The audio processor (not shown) in the controller 170 may perform processing such as adjustment of bass, treble, and volume.

The data processor (not shown) in the controller 170 may perform data processing on the demultiplexed data signal. For example, if the demultiplexed data signal is a coded data signal, the data processor (not shown) may decode the data signal. The coded data signal may be electronic program guide (EPG) information containing broadcast information such as a start time and an end time of a broadcast program broadcast on each channel.

Although the formatter 360 performs 3D processing after the mixer 345 mixes the signals received from the OSD generator 340 and the image processing unit 320 in FIG. 3, embodiments of the present invention are not limited thereto and the mixer 345 may be disposed after the formatter 360. That is, after the formatter 360 performs 3D processing on the output of the image processing unit 320 and the OSD generator 340 generates the OSD signal and performs 3D processing, the mixer 345 may mix the 3D processed signals.

FIG. 3 is a block diagram of the controller 170 according to an embodiment of the present invention. Constituents of the block diagram may be integrated, added or omitted according to the specifications of the controller 170 as actually implemented.

In particular, the frame rate converter 350 and the formatter 360 may not be provided in the controller 170. Instead, they may be provided individually or provided as one separate module.

Figure 4:
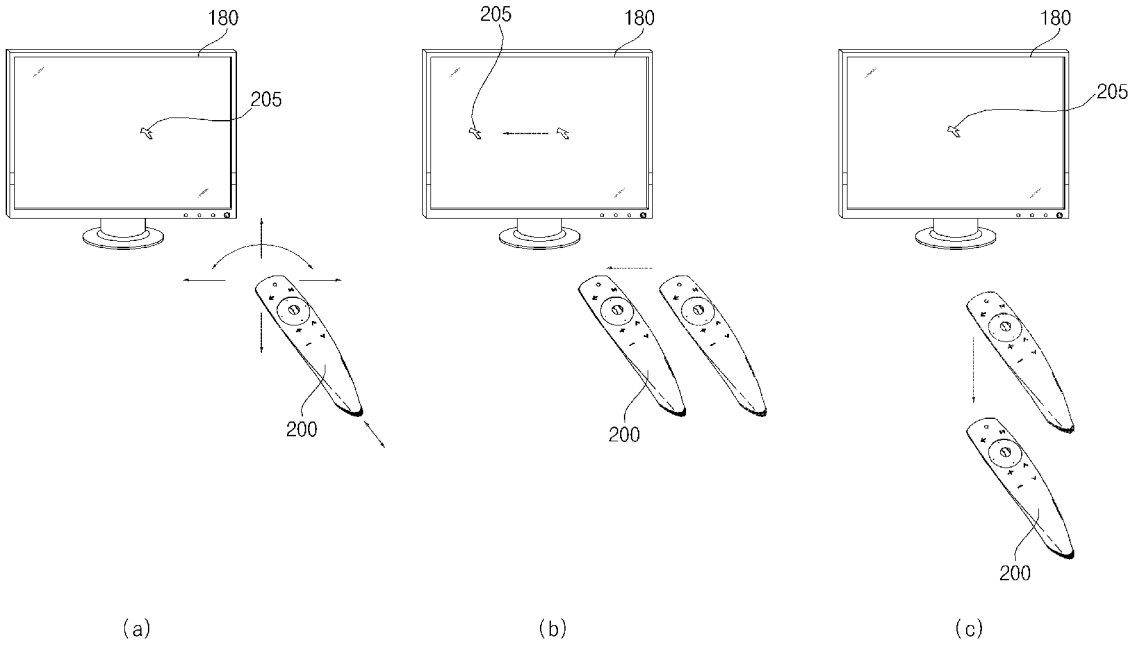
FIG. 4 is a view illustrating a method of controlling a remote controller illustrated in FIG. 2.

FIG. 4 is a view illustrating a method of controlling the remote controller illustrated in FIG. 2.

As illustrated in (a) of FIG. 4, a pointer 205 corresponding to the remote controller 200 may be displayed on the display module 180.

A user may move the remote controller 200 up and down, left and right ((b) of FIG. 4), or back and forth ((c) of FIG. 4) or rotate the same. The pointer 205 displayed on the display module 180 of the image display apparatus moves according to movement of the remote controller 200. As illustrated in the figure, since the pointer 205 moves according to movement of the remote controller 200 in a 3D space, the remote controller 200 may be referred to as a spatial remote controller or a 3D pointing device.

(b) of FIG. 4 illustrates a case in which the pointer 205 displayed on the display module 180 moves to the left when the user moves the remote controller 200 to the left.

Information about movement of the remote controller 200 sensed through a sensor of the remote controller 200 is transmitted to the image display apparatus. The image display apparatus may calculate coordinates of the pointer 205 based on the information about the movement of the remote controller 200. The image display apparatus may display the pointer 205 such that the pointer 205 corresponds to the calculated coordinates.

(c) of FIG. 4 illustrates a case in which the user moves the remote controller 200 away from display module 180 while pressing down a specific button on the remote controller 200. In this case, a selected area on the display module 180 corresponding to the pointer 205 may be zoomed in and displayed with a magnified size. On the contrary, when the user moves the remote controller 200 closer to the display module 180, the selected area may be zoomed out and displayed with a reduced size. Alternatively, the selected area may be zoomed out when the remote controller 200 is moved away from the display module 180 and may be zoomed in when the remote controller 200 is moved closer to the display module 180.

Up-and-down and left-and-right movements of the remote controller 200 may not be recognized while the specific button on the remote controller 200 is pressed down. That is, when the remote controller 200 moves away from the display module 180 or approaches the display module 180, the up-and-down and left-and-right movements of the remote controller 200 may not be recognized and only back-and-forth movement of the remote controller 200 may be recognized. If the specific button on the remote controller 200 is not pressed down, only the pointer 205 moves according to the up-and-down and left-and-right movements of the remote controller 200.

The speed and direction of movement of the pointer 205 may correspond to the speed and direction of movement of the remote controller 200.

Figure 5:
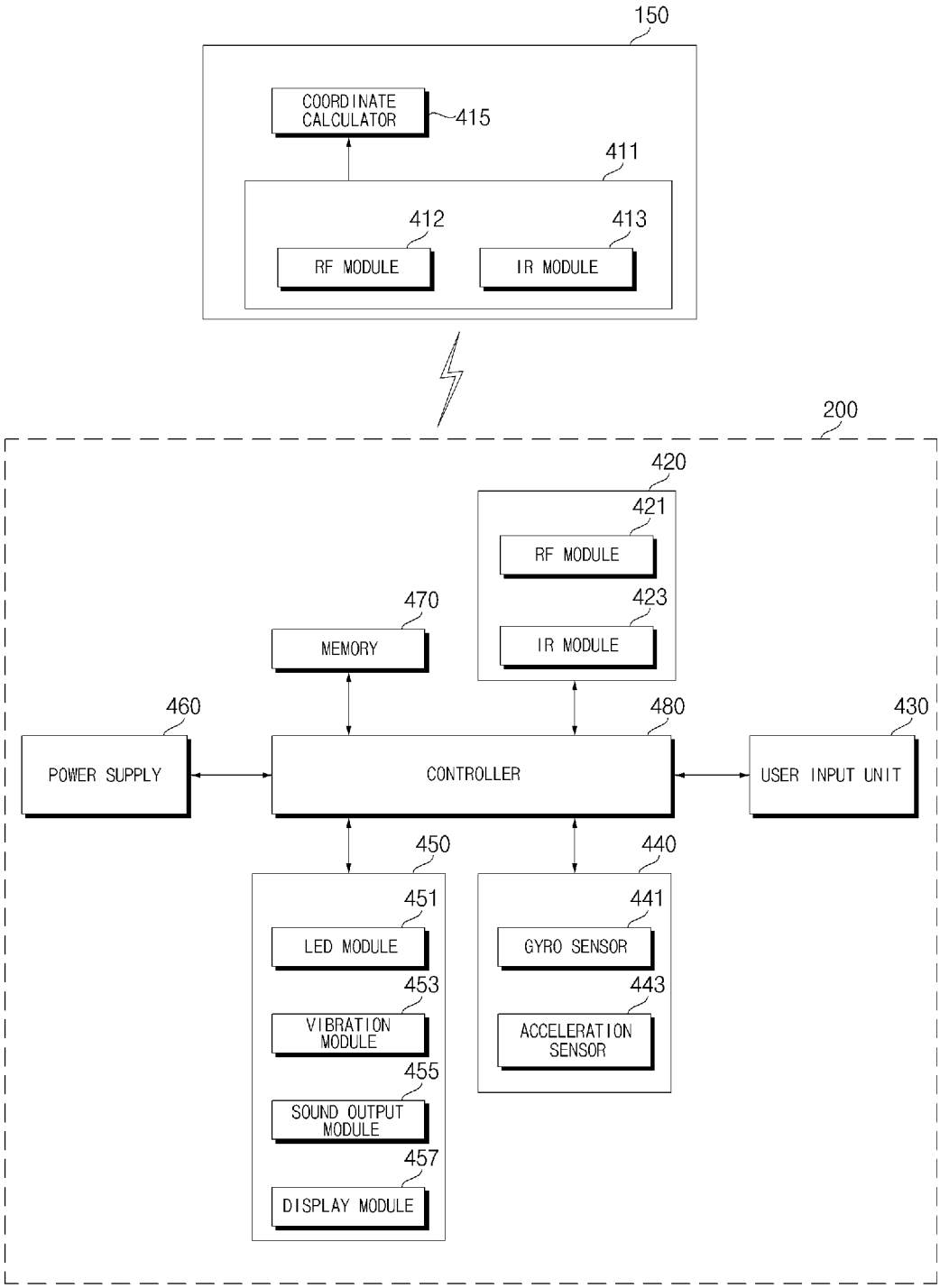
FIG. 5 is a block diagram illustrating an internal configuration of the remote controller illustrated in FIG. 2.

FIG. 5 is a block diagram illustrating an internal configuration of the remote controller illustrated in FIG. 2.

Referring to FIG. 5, the remote controller 200 may include a wireless communication unit 420, a user input unit 430, a sensor unit 440, an output unit 450, a power supply 460, a memory 470, and a controller 480.

The wireless communication unit 420 transmits and receives signals to and from one of the image display apparatuses according to embodiments of the present invention described above. Hereinafter, one image display apparatus 100 among the image display apparatuses according to embodiments of the present invention will be described by way of example.

In this embodiment, the wireless communication unit 420 may include an RF module 421 capable of transmitting and receiving signals to and from the image display apparatus 100 according to an RF communication standard. The wireless communication unit 420 may further include an IR module 423 capable of transmitting and receiving signals to and from the image display apparatus 100 according to an IR communication standard.

In this embodiment, the remote controller 200 transmits a signal containing information about movement of the remote controller 200 to the image display apparatus 100 via the RF module 421.

In addition, the remote controller 200 may receive a signal from the image display apparatus 100 via the RF module 421. As needed, the remote controller 200 may transmit commands related to power on/off, channel change, and volume change to the image display apparatus 100 via the IR module 423.

The user input unit 430 may include a keypad, buttons, a touchpad, or a touchscreen. The user may input a command related to the display apparatus 100 to the remote controller 200 by manipulating the user input unit 430. If the user input unit 430 includes a hard key button, the user may input a command related to the image display apparatus 100 to the remote controller 200 by pressing the hard key button. If the user input unit 430 includes a touchscreen, the user may input a command related to the image display apparatus 100 to the remote controller 200 by touching a soft key on the touchscreen. The user input unit 430 may include various types of input means such as a scroll key and a jog key which can be manipulated by the user and this embodiment does not limit the scope of the present invention.

The sensor unit 440 may include a gyro sensor 441 or an acceleration sensor 443. The gyro sensor 441 may sense information about movement of the remote controller 200.

For example, the gyro sensor 441 may sense information about movement of the remote controller 200 with respect to the X, Y and Z axes. The acceleration sensor 443 may sense information about the movement speed of the remote controller 200. The sensor unit 440 may further include a distance measurement sensor to sense a distance to the display module 180.

The output unit 450 may output an image signal or audio signal corresponding to manipulation of the user input unit 435 or the signal transmitted by the image display apparatus 100. The user may recognize, via the output unit 450, whether the user input unit 435 is manipulated or the image display apparatus 100 is controlled.

For example, the output unit 450 may include an LED module 451 to be turned on, a vibration module 453 to generate vibration, a sound output module 455 to output sound, or a display module 457 to output an image, when the user input unit 435 is manipulated or signals are transmitted to and received from the image display apparatus 100 via the wireless communication unit 425.

The power supply 460 supplies power to the remote controller 200. If the remote controller 200 does not move for a predetermined time, the power supply 460 may stop supplying power to reduce waste of power. The power supply 460 may resume supply of power when a predetermined key provided to the remote controller 200 is manipulated.

The memory 470 may store various types of programs and application data necessary for control or operation of the remote controller 200. When the remote controller 200 wirelessly transmits and receives signals to and from the image display apparatus 100 via the RF module 421, the remote controller 200 and the image display apparatus 100 may transmit and receive signals in a predetermined frequency band. The controller 480 of the remote controller 200 may store, in the memory 470, information about a frequency band enabling wireless transmission and reception of signals to and from the image display apparatus 100 which is paired with the remote controller 200, and reference the information.

The controller 480 controls overall operation related to control of the remote controller 200. The controller 480 may transmit a signal corresponding to manipulation of a predetermined key in the user input unit 435 or a signal corresponding to movement of the remote controller 200 sensed by the sensor unit 440 to the image display apparatus 100 via the wireless communication unit 420.

The user input interface unit 150 of the image display apparatus 100 may include a wireless communication unit 411 capable of wirelessly transmitting and receiving signals to and from the remote controller 200 and a coordinate calculator 415 capable of calculating coordinates of a pointer corresponding to operation of the remote controller 200.

The user input interface unit 150 may wirelessly transmit and receive signals to and from the remote controller 200 via an RF module 412. In addition, the user input interface unit 150 may receive, via an IR module 413, a signal transmitted from the remote controller 200 according to an IR communication standard.

The coordinate calculator 415 may calculate a coordinate value (x, y) of the pointer 205 to be displayed on the display module 180 by correcting hand tremor or errors in a signal corresponding to operation of the remote controller 200, which is received via the wireless communication unit 411.

The signal which is transmitted by the remote controller 200 and input to the image display apparatus 100 via the user input interface unit 150 is transmitted to the controller 170 of the image display apparatus 100. The controller 170 may determine information about an operation of the remote controller 200 or manipulation of a key from the signal transmitted by the remote controller 200 and control the image display apparatus 100 based on the information.

As another example, the remote controller 200 may calculate a coordinate value of a pointer corresponding to movement thereof and output the coordinate value to the user input interface unit 150 of the image display apparatus 100. In this case, the user input interface unit 150 of the image display apparatus 100 may transmit, to the controller 170, information about the received coordinate value of the pointer without separately correcting hand tremor or errors.

As another example, the coordinate calculator 415 may be provided in the controller 170 rather than in the user input interface unit 150 as opposed to FIG. 5.

Figure 6:
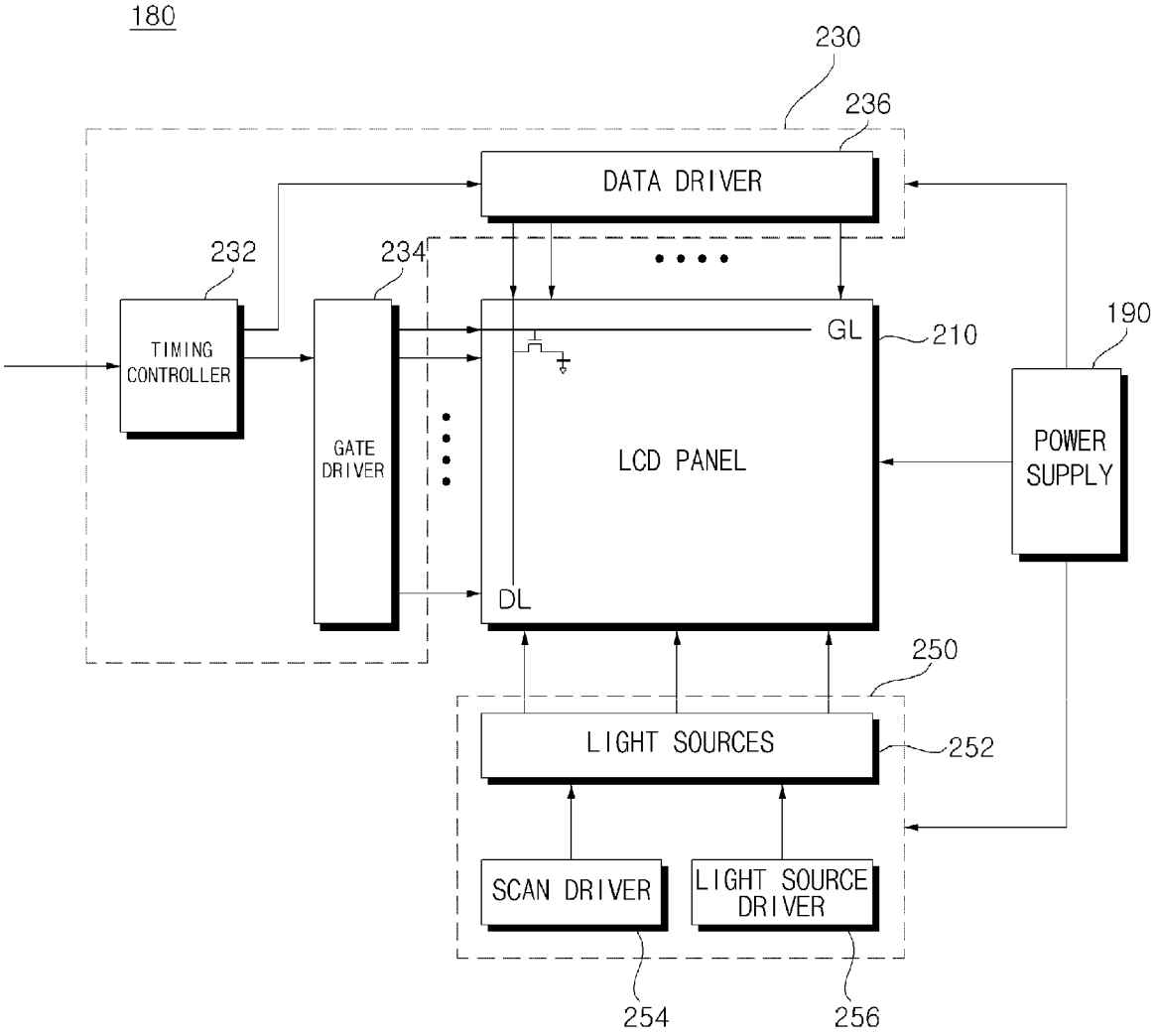
FIG. 6 is a diagram of a power supply and an internal construction of a display module illustrated in FIG. 2.

FIG. 6 is a diagram of the power supply and an internal construction of the display module illustrated in FIG. 2.

Referring to FIG. 6, the LCD panel based display module 180 may include an LCD panel 210, a driving circuit unit 230, and a backlight unit 250.

To display images, the LCD panel 210 includes a first substrate on which a plurality of gate lines GL and a plurality of data lines DL intersect in a matrix form and thin film transistors (TFTs) and pixel electrodes connected to the TFTs are formed at the intersections, a second substrate including common electrodes, and a liquid crystal layer formed between the first substrate and the second substrate.

The driving circuit unit 230 drives the LCD panel 210 through a control signal and a data signal supplied by the controller 170 illustrated in FIG. 2. To this end, the driving circuit unit 230 includes a timing controller 232, a gate driver 234, and a data driver 236.

The timing controller 232 receives a control signal, an RGB data signal, and a vertical synchronization signal Vsync from the controller 170, controls the gate driver 234 and the data driver 236 based on the control signal, re-arranges the RGB data signal, and provides the re-arranged RGB data signal to the data driver 236.

The gate driver 234 and the data driver 236 provide a scan signal and a video signal to the LCD panel 210 through the gate lines GL and the data lines DL under the control of the timing controller 232.

The backlight unit 250 supplies light to the LCD panel 210. To this end, the backlight unit 250 may include a plurality of light sources 252, a scan driver 254 for controlling scanning driving of the light sources 252, and a light source driver 256 for turning on or off the light sources 252.

A predetermined image is displayed by light emitted from the backlight unit 250 in a state in which light transmittance of the liquid crystal layer is controlled by an electrical field between the pixel electrodes and the common electrodes of the LCD panel 210.

The power supply 190 may supply a common electrode voltage Vcom to the LCD panel 210 and a gamma voltage to the data driver 236. In addition, the power supply 190 supplies a driving voltage for driving the light sources 252 to the backlight unit 250.

Figure 7:
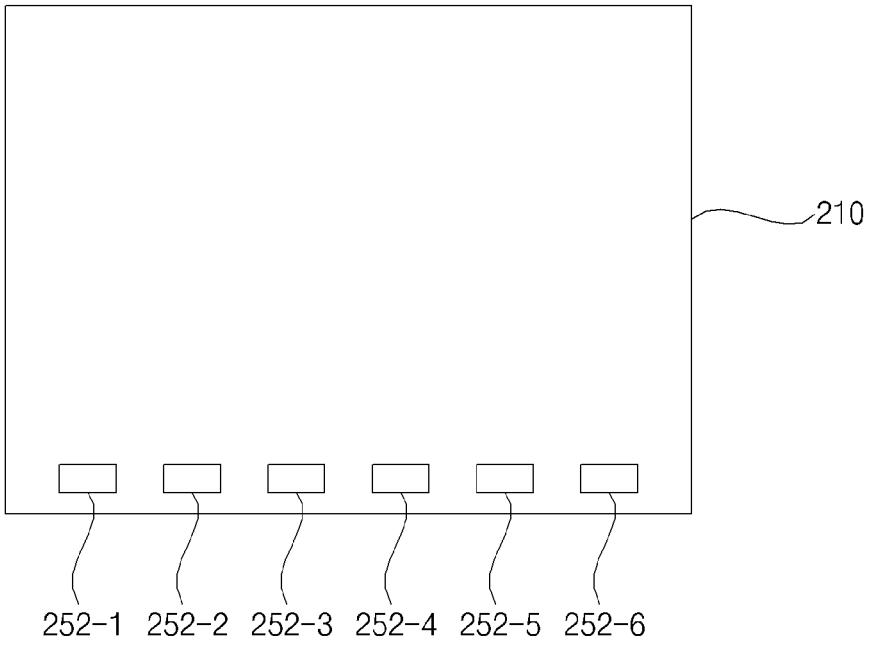
FIG. 7 is a diagram illustrating exemplary arrangement of light sources illustrated in FIG. 6.

FIG. 7 is a diagram illustrating exemplary arrangement of the light sources illustrated in FIG. 6.

Referring to FIG. 7, a plurality of light sources 252-1 to 252-6 may be disposed at a lower edge of the back surface of the LCD panel 210.

In FIG. 7, 6 light sources 252-1 to 252-6 are separately disposed.

Each of the light sources 252-1 to 252-6 may include a plurality of LEDs. Meanwhile, light is radiated onto the front surface of the LCD panel 210 by means of a diffusion plate that diffuses light, a reflection plate that reflects light, or an optical sheet that polarizes, scatters, and diffuses light.

Meanwhile, each of the light sources 252-1 to 252-6 may include a plurality of LEDs that are connected in series. Thus, the same current may flow into the light sources 252-1 to 252-6.

Figure 8:
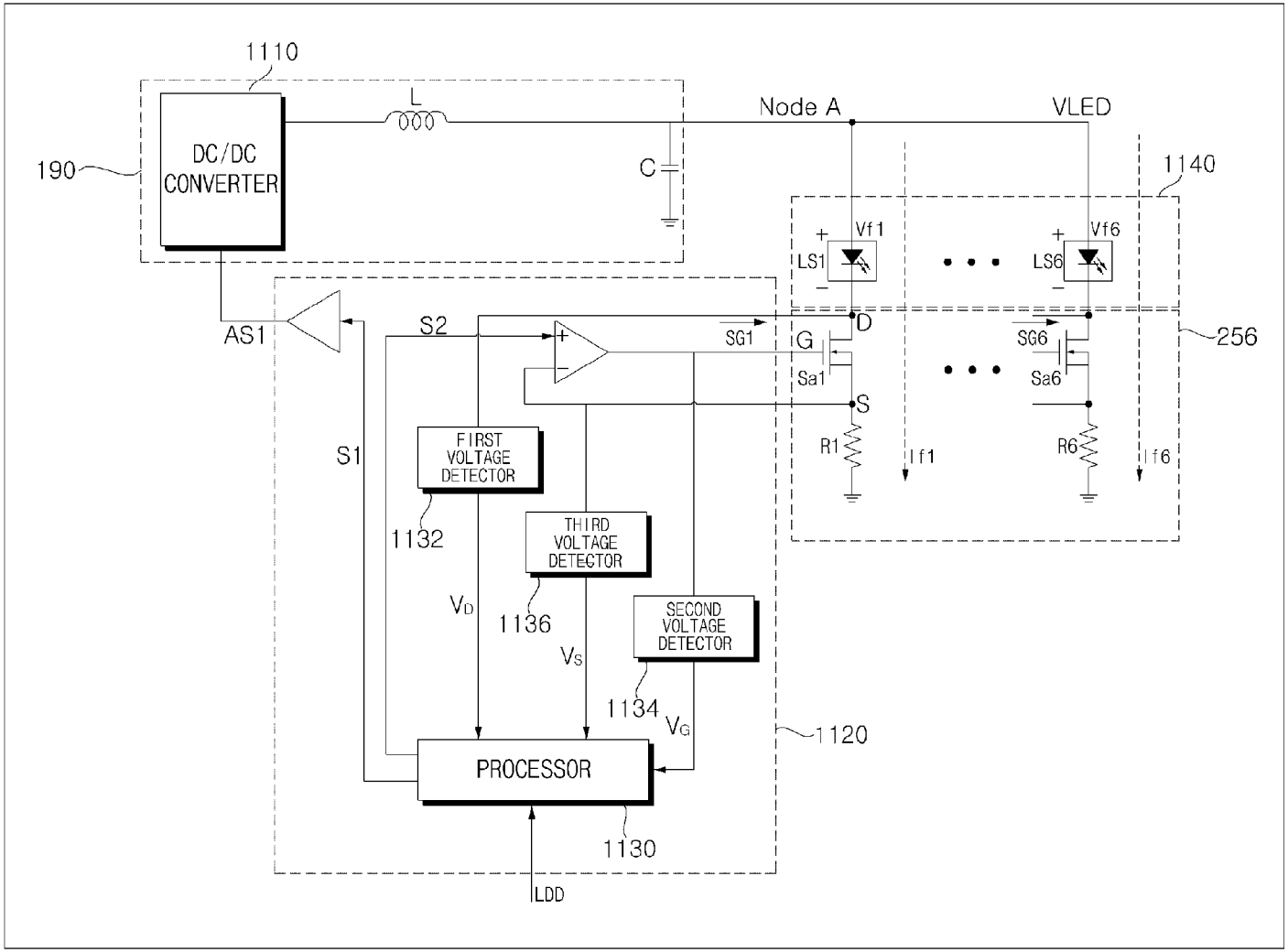
FIG. 8 is a circuit diagram illustrating an internal configuration of a light driver according to an embodiment of the present invention.

FIG. 8 is a circuit diagram illustrating an internal configuration of a light driver according to an embodiment of the present invention.

Referring to FIG. 8, the light source driver 256 may include a plurality of light sources LS1 to LS6 1140 connected in parallel to each other, the power supply 190 for supplying a common power voltage VLED to the light sources LS1 to LS6 1140, the light source driver 256 for driving the light sources LS1 to LS6 1140, and a driving controller 1120 for controlling the light source driver 256.

Herein, each of the light sources LS1 to LS6 may include a plurality of LEDs connected in series.

As described above, as resolution of the image display apparatus 100 increases up to HD, full HD, UHD, 4K, or 8K, the number of LEDs may increase.

Meanwhile, when the LCD panel 210 is a high resolution panel, it is desirable to allow currents If of variable levels to flow into the light sources 252-1 to 252-6 among the light sources 252 based on local dimming data in order to improve contrast.

According to this, the currents If of variable levels flow in proportion to the local dimming data so that each of the light sources 252-1 to 252-6 outputs light of different illuminance according to the local dimming data.

Then, illuminance of a bright part becomes brighter and illuminance of a dart part becomes darker due to the current If of an increased level. As a result, contrast is improved in displaying images.

The power supply 190 outputs the common voltage VLED to the light sources. To this end, the power supply 190 may include a DC/DC converter for converting the level of a DC power, an inductor L for eliminating harmonics, and a capacitor C for storing the DC power.

A voltage across both ends of the capacitor C may correspond to a voltage supplied between a node A and a ground terminal and correspond to a voltage applied to the light sources LS1 to LS6 1140, a plurality of switching elements Sa1 to Sa6, and resistor elements R1 to R6. That is, the voltage of the node A is a common voltage supplied to the light sources LS1 to LS6 and may be referred to as a VLED voltage as shown.

The VLED voltage is equal to the sum of a driving voltage Vf1 of the first light source LS1, a voltage of both ends of the first switching element Sa, and a voltage consumed in the first resistor element Ra.

Alternatively, the VLED voltage is equal to the sum of a driving voltage Vf2 of the second light source LS2, a voltage of both ends of the second switching element Sa2, and a voltage consumed in the second resistor element Rb. Alternatively, the VLED voltage is equal to the sum of a driving voltage Vf6 of the sixth light source LS6, a voltage of both ends of the sixth switching element Sa6, and a voltage consumed in the n-th resistor element Rn (?? the sixth resistor element R6).

Meanwhile, as resolution of the LCD panel 210 increases, the light source driving voltages Vf1 to Vf6 increase and driving currents If1 to If6 flowing into the light sources also increase.

Accordingly, power consumed by the switching elements Sa1 to Sa6 and the resistor elements R1 to R6 increases and thus stress of the switching elements Sa1 to Sa6 and the resistor R1 to R6 also increases.

To reduce power consumption while the light sources are driven, it is desirable to reduce the driving currents If1 to If6 flowing into the switching elements Sa1 to Sa6 and the resistor elements R1 to R6. In this case, it is assumed that the light source driving voltages Vf1 to Vf6 are constant.

To this end, the driving controller 1120 includes a first voltage detector 1132 for detecting a voltage $V_D$ of a drain terminal D of each of the switching elements Sa1 to Sa6 configured by FETs. The driving controller 1120 may further include a second voltage detector 1134 for detecting a voltage $V_G$ of a gate terminal G of each of the switching elements Sa1 to Sa6 and a third voltage detector 1136 for detecting a voltage $V_S$ of a source terminal S of each of the switching elements Sa1 to Sa6.

The driving controller 1120 may compare drain terminal voltages $V_D$ of the respective drain terminals of the switching elements Sa1 to Sa6 with each other, generate target driving currents flowing into the light sources 1140 based on a minimum drain terminal voltage among the drain terminal voltages, and generate switching control signals SG corresponding to the generated target driving currents.

Each switching control signal SG is input to a comparator. If the level of the switching control signal SG is greater than the voltage $V_D$ of the source terminal, the switching control signal SG is output from the comparator and input to the gate terminal G. Consequently, the switching element is driven based on the switching control signal SG.

To generate the switching control signal, the driving controller 1120 may include a processor 1130 that generates the switching control signal for driving the gate terminal of each of the switching elements Sa1 to Sa6 based on the voltage of the drain terminal of each of the switching elements Sa1 to Sa6.

Meanwhile, the processor 1130 may vary a duty of the switching control signal SG based on the magnitude of the voltage $V_D$ of the drain terminal of each of the switching elements Sa1 to Sa6.

In accordance with an embodiment of the present invention, when the difference in local dimming data of an input image between a first region and a second region which are adjacent is above a first reference value, the processor 1130 may control driving times of at least some of the switching elements Sa1 to Sa6 to decrease the difference in illuminance between the first region and the second region, based on illuminance sensed by the illuminance sensor 195.

Meanwhile, when the difference in local dimming data of the input image between the first region and the second region which are adjacent is above the first reference value, the processor 1130 may control driving times of switching elements corresponding to the first region and the second region among the switching elements Sa1 to Sa6 to decrease the difference in illuminance between the first region and the second region, based on the illuminance sensed by the illuminance sensor 195.

On the other hand, when the difference in local dimming data of the input image between the first region and the second region which are adjacent is above the first reference value, the processor 1130 may control driving times of at least some of the switching elements Sa1 to Sa6 to be increased, as the sensed illuminance decreases.

When the difference in local dimming data of the input image between the first region and the second region which are adjacent is above a first reference value, the processor 1130 may control driving times of switching elements corresponding to the first region and the second region among the switching elements Sa1 to Sa6 to be increased, as the sensed illuminance decreases.

When the difference in local dimming data of the input image between the first region and the second region which are adjacent is above the first reference value and when the illuminance sensed by the illuminance sensor 195 is less than a second reference value, the processor 1130 may control driving times of at least some of the switching elements Sa1 to Sa6 to decrease the difference in illuminance between the first region and the second region, based on the sensed illuminance.

Meanwhile, the processor 1130 may calculate first duties of switching control signals applied to the switching elements Sa1 to Sa6, based on local dimming data. When the difference in local dimming data of the input image between the first region and the second region which are adjacent is above the first reference value, the processor 1130 may calculate second duties to decrease the difference in illuminance between the first region and the second region, based on the illuminance sensed by the illuminance sensor 195. Then, the processor 1130 may apply switching control signals corresponding to third duties obtained by adding the first duties and the second duties to the switching elements Sa1 to Sa6.

The processor 1130 may control second duties of switching elements corresponding to the first region and the second region among the switching elements Sa1 to Sa6 to be greater than second duties of the other switching elements.

The processor 1130 may control the second duties to be increased as the sensed illuminance decreases.

When the difference in local dimming data of the input image between the first region and the second region which are adjacent is above the first reference value, the processor 1130 may control the difference in illuminance between light sources corresponding to the first region and the second region among the light sources 252-1 to 252-6 to be less than the difference in illuminance or local dimming data between the first region and the second region of the input image.

Alternatively, the processor 1130 may control driving times of the light sources 252-1 to 252-6 to be variable, based on the sensed illuminance.

The processor 1130 may control the driving times of the light sources 252-1 to 252-6 to be increased, as the sensed illuminance decreases.

When the difference in local dimming data between the first region and the second region which are adjacent is above the first reference value, the processor 1130 may control driving times of at least some of the light sources 252-1 to 252-6 to decrease the difference in illuminance between the first region and the second region, based on the illuminance sensed by the illuminance sensor 195.

Figure 9A:
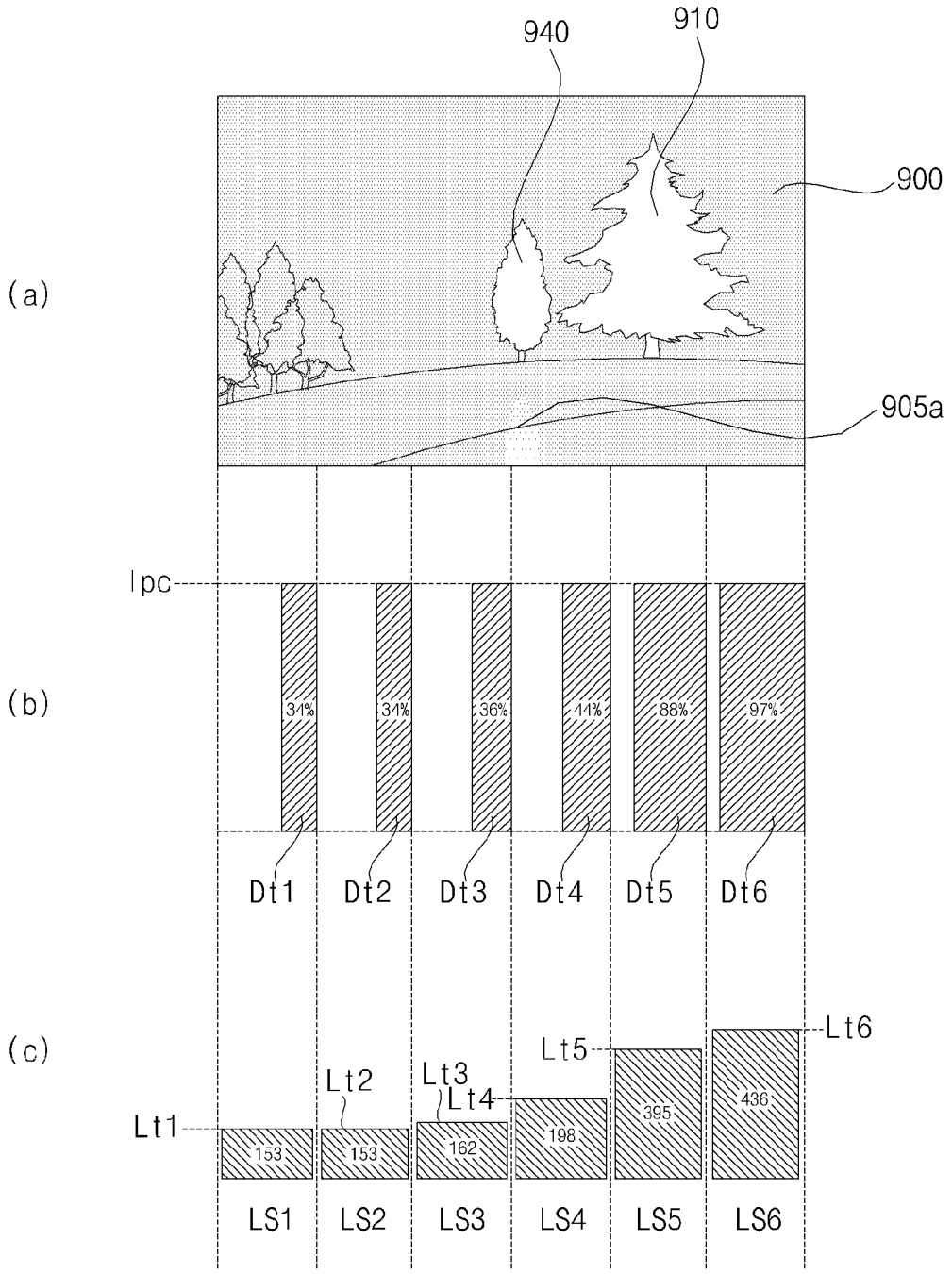
FIGS. 9A to 9C are diagrams referred to for explaining a halo phenomenon in displaying images.
Figure 9B:
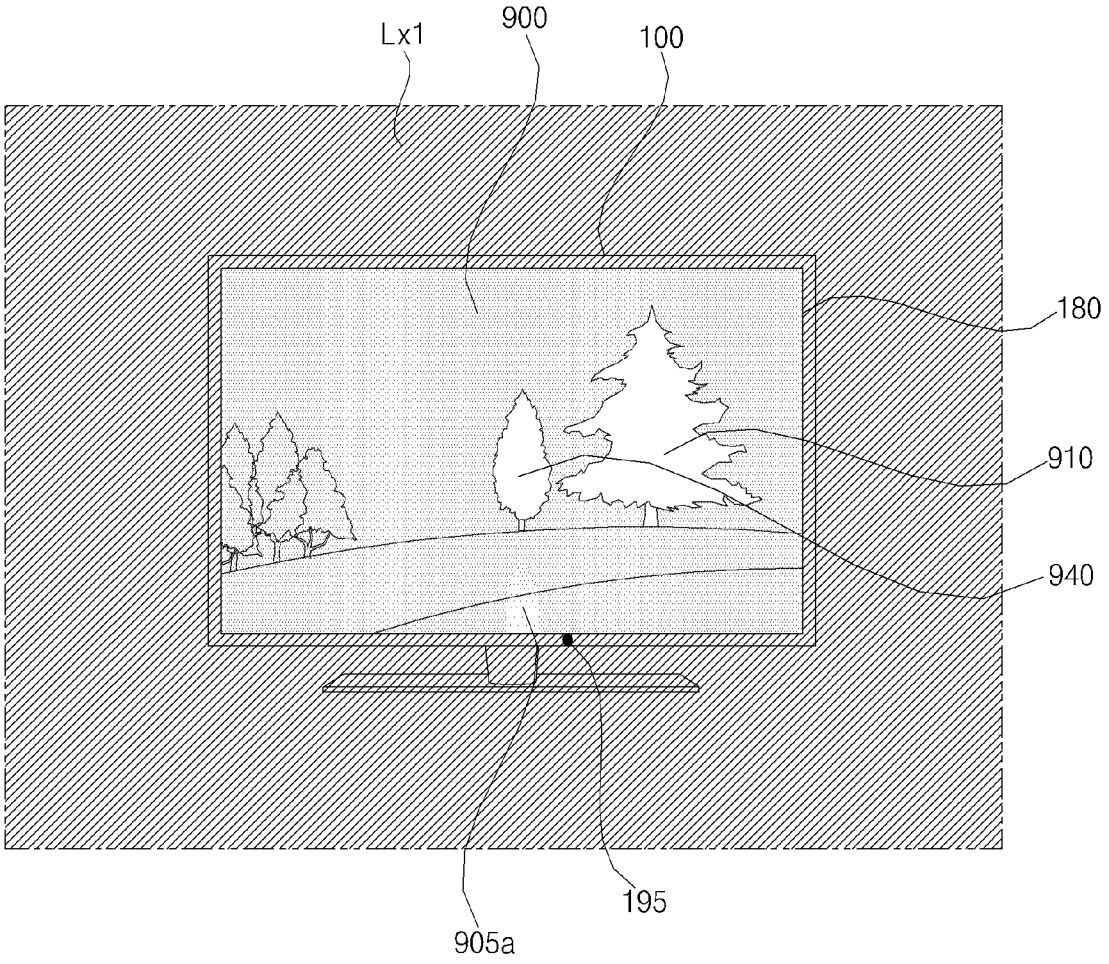
Figure 9C:
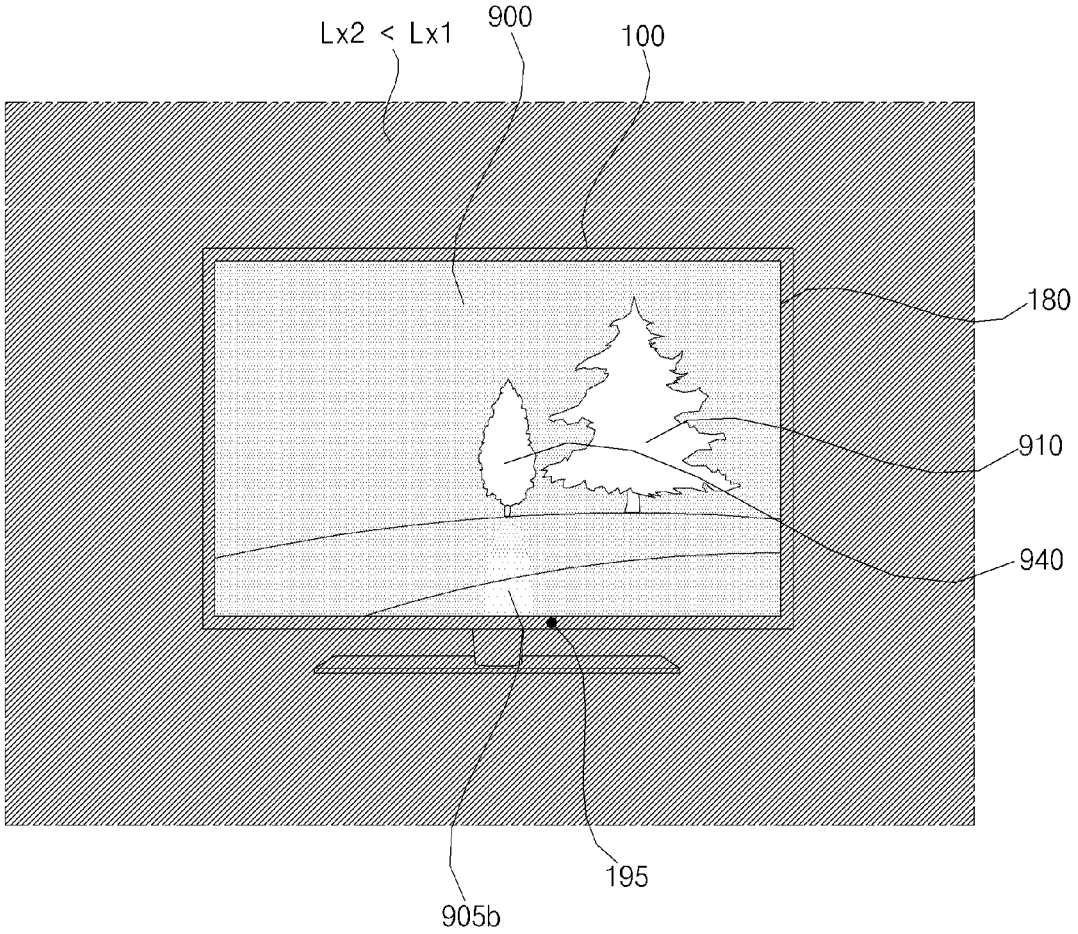

FIGS. 9A to 9C are diagrams referred to for explaining a halo phenomenon in displaying images.

In FIG. 9A, (a) illustrates an example of an input image 900. The input image 900 is mostly dark but has a bright region in some objects 940 and 910.

Accordingly, if a plurality of light sources LS1 to LS6 is separately disposed at a lower edge of the back surface of the display panel 210, as illustrated in FIG. 7, then the first to third light sources LS1 to LS3 may be to be relatively low in illuminance, the fourth light source LS4 may be to be high in illuminance, and the fifth light source LS5 and sixth light source LS6 may be to be extremely high in illuminance.

To this end, the processor 1130 described with reference to FIG. 8 may control duties of switching control signals applied to switching elements Sa1 to Sa6 for driving the light sources LS1 to LS6 to be Dt1 to Dt6, respectively, as illustrated in (b) of FIG. 9A.

Herein, Dt1 to Dt6 may be 34%, 34%, 36%, 44%, 88%, and 97%, respectively, as illustrated in (b) of FIG. 9A. Therefore, illuminances output from the light sources LS1 to LS6 may be Lt1 to Lt6, as illustrated in (c) of FIG. 9A.

Herein, Lt1 to Lt6 may be 153, 153, 162, 198, 395, and 436 nit, respectively, as illustrated in (c) of FIG. 9A.

Referring to (b) of FIG. 9A, a duty of a switching control signal applied to the switching element Sa4 corresponding to the fourth light source LS4 is approximately 44% and a duty of a switching control signal applied to the switching element Say corresponding to the fifth light source LS5 is approximately 88% which is a big difference as compared with 44%.

In this case, when the image 900 is displayed on the display module 180, there is considerable difference in illuminance between a region corresponding to the fourth light source LS4 and a region corresponding to the fifth light source LS5, as illustrated in (c) of FIG. 9A. Therefore, a region corresponding to the fourth light source LS4, particularly, a region around the fourth light source LS4, appears to leak light, unlike other regions.

Such a phenomenon is called a halo phenomenon. As illustrated in (a) of FIG. 9A, a halo phenomenon region 905*a* occurs in a region around the fourth light source LS4.

The halo phenomenon becomes severer as the periphery of the image display apparatus 100, particularly, the display module 180 becomes darker. That is, a region in which light appears to leak may be increased.

FIG. 9B illustrates that the image 900 illustrated in (a) of FIG. 9A is displayed on the display module 180 of the image display apparatus 100 at an ambient illuminance of Lx1.

As described with reference to FIG. 9A, the halo phenomenon region 905*a* occurs in a region around the fourth light source LS4 as described with reference to FIG. 9A, thereby lowering visibility while a user views the image 900.

FIG. 9C illustrates that the image 900 is displayed on the display module 180 of the image display apparatus 100 at an ambient illuminance of Lx2. Particularly, FIG. 9C shows that the ambient illuminance Lx2 is darker than the ambient illuminance Lx1 of FIG. 9B (i.e., Lx2<Lx1).

Similar to the description given with reference to FIG. 9B, a halo phenomenon region 905*b* occurs in a region around the fourth light source LS4. In this case, the halo phenomenon region 905*b* is larger than the halo phenomenon region 905*a* illustrated in FIG. 9B, thereby lowering visibility while a user views the image 900.

The present invention proposes a method of preventing this halo phenomenon, which will now be described with reference to FIG. 10.

Figure 10:
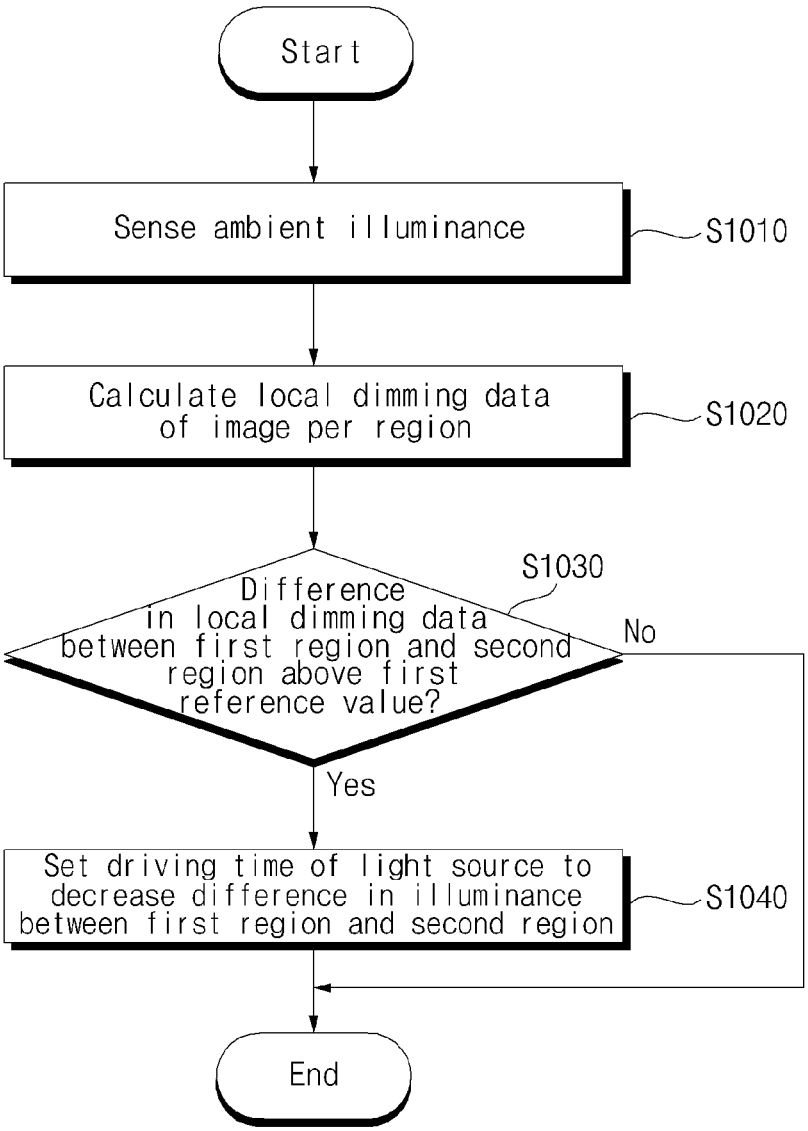
FIG. 10 is a flowchart illustrating an operation of an image display apparatus according to an embodiment of the present invention.

FIG. 10 is a flowchart illustrating an operation of an image display apparatus according to an embodiment of the present invention.

Referring to FIG. 10, the illuminance sensor 195 of the image display apparatus 100 senses an ambient illuminance (S1010). Information about the illuminance sensed by the illuminance sensor 195 may be input to the controller 170.

The controller 170 of the image display apparatus 100 calculates local dimming data per region of an input image (S1020).

The controller 170 of the image display apparatus 100 may calculate the local dimming data per region, in units of frames, with respect to the input image.

Particularly, the controller 170 of the image display apparatus 100 may calculate local dimming data corresponding to each of the light sources LS1 to LS6.

The controller 170 of the image display apparatus 100 may transmit the calculated local dimming data and the information about the sensed illuminance to the display module 180.

The light source driver 256 in the display module 180 may receive the calculated local dimming data and the information about the sensed illuminance.

Particularly, the processor 1130 in the light source driver 256 may receive the calculated local dimming data and the information about the sensed illuminance.

The processor 1130 in the light source driver 256 determines whether the difference in local dimming data between adjacent first and second regions among a plurality of regions is above a first reference value (S1030).

If it is determined that the difference is above the first reference value, the processor 1130 in the light source driver 256 sets a driving time of a light source to decrease that the difference in illuminance between the first region and the second region, based on the information about the sensed illuminance (S1040).

For example, the first reference value may be approximately 30% based on duty.

If the local dimming data has a value of 0 to 55, the first reference value may be approximately 80.

When the difference in local dimming data, illuminance, or duty between a region corresponding to the fourth light source LS4 and a region corresponding to the fifth light source LS5 is above the first reference value as illustrated in FIG. 9A, the processor 1130 in the light source driver 256 may control driving times of at least some of the switching elements Sa1 to Sa6 to decrease the difference in illuminance between the corresponding regions in order to prevent a halo phenomenon.

Particularly, the processor 1130 may increase driving times of at least some of the switching elements Sa1 to Sa6.

For example, the processor 1130 may increase a duty of the fourth switching element corresponding to the fourth light source LS4 and a duty of the fifth switching element corresponding to the fifth light source LS5, so that the difference in illuminance between a region corresponding to the fourth light source LS4 and a region corresponding to the fifth light source LS5 illustrated in FIG. 9A becomes small.

The processor 1130 may greatly increase the duty of the fourth switching element so that the difference in duty between the fourth switching element and the fifth switching element becomes smaller.

Although the processor 1130 may increase only the duties of the fourth and fifth switching elements Sa4 and Sa5, it is possible to increase duties of all of the first to sixth switching elements Sa1 to Sa6.

In this case, as a preset duty becomes bigger, the processor 1130 may control an added duty to become smaller. Thereby, the difference in duty between regions is decreased and the difference in illuminance between regions is also decreased.

In this way, the processor 1130 increases driving times of at least some of the switching elements Sa1 to Sa6 such that the difference in illuminance between corresponding regions becomes smaller. Therefore, a halo phenomenon caused by the difference in illuminance between adjacent regions is reduced.

Particularly, the processor 1130 in the light source driver 256 increases the driving times of at least some of the switching elements Sa1 to Sa6 as the sensed illuminance decreases. Thereby, the halo phenomenon is prevented according to an ambient illuminance situation.

Figure 11A:
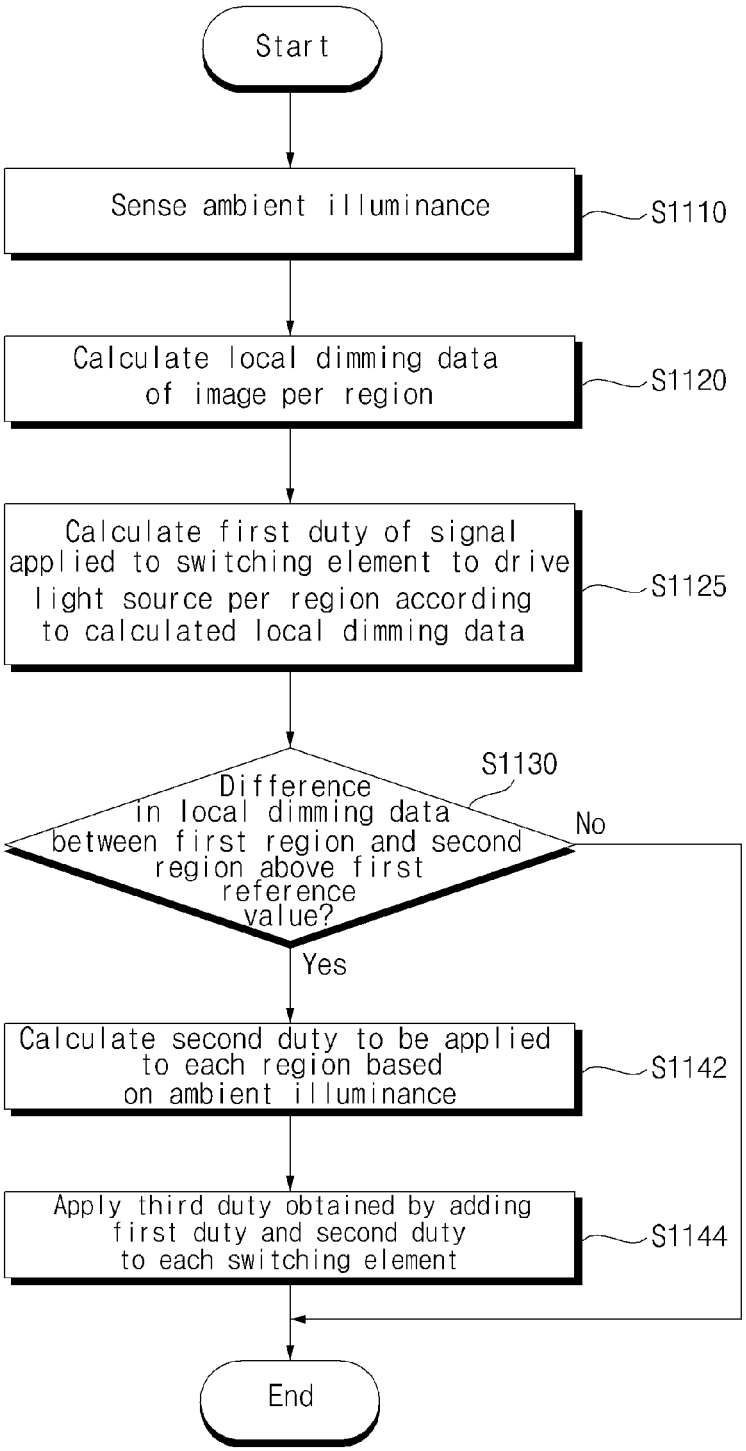
FIG. 11A and FIG. 11B are flowcharts illustrating an operation of an image display apparatus according to various embodiments of the present invention.
Figure 11B:
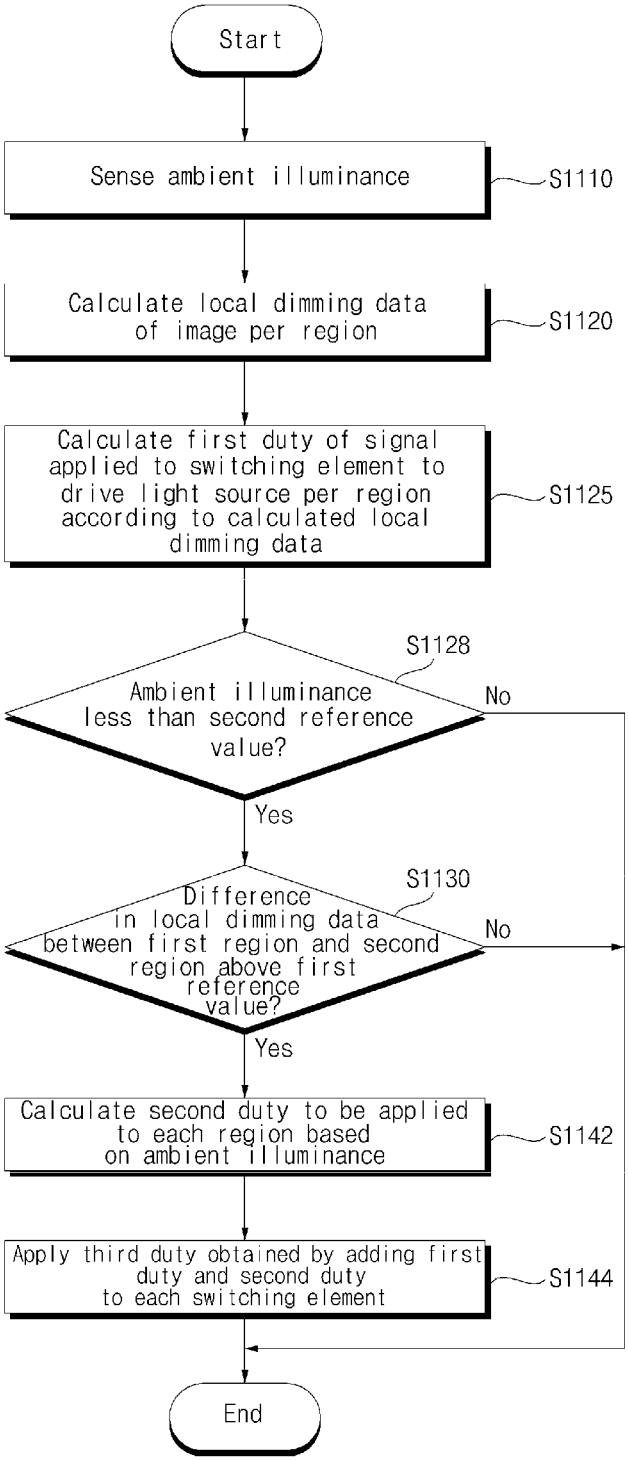

FIG. 11A and FIG. 11B are flowcharts illustrating an operation of an image display apparatus according to various embodiments of the present invention.

Referring to FIG. 11A, the illuminance sensor 195 of the image display apparatus 100 senses an ambient illuminance (S1110). Information about the illuminance sensed by the illuminance sensor 195 may be input to the controller 170.

The controller 170 of the image display apparatus 100 calculates local dimming data per region of an input image (S1120).

The controller 170 of the image display apparatus 100 may calculate the local dimming data per region, in units of frames, with respect to the input image.

Particularly, the controller 170 of the image display apparatus 100 may calculate local dimming data corresponding to each of the light sources LS1 to LS6.

The controller 170 of the image display apparatus 100 may transmit the calculated local dimming data and the information about the sensed illuminance to the display module 180.

The light source driver 256 in the display module 180 may receive the calculated local dimming data and the information about the sensed illuminance.

Particularly, the processor 1130 in the light source driver 256 may receive the calculated local dimming data and the information about the sensed illuminance.

The processor in the light source driver 256 calculates a first duty of a switching control signal in order to drive a light source corresponding to each region according to the calculated local dimming data (S1125).

For example, in order to display the image 900 of FIG. 9A, the processor 1130 may control duties of the respective switching elements Sa1 to Sa6 to be Dt1 to Dt6, respectively. Herein, each of Dt1 to Dt6 may be referred to as the first duty.

Next, the processor 1130 in the light source driver 256 determines whether the difference in local dimming data between adjacent first and second regions among a plurality of regions is above a first reference value (S1130).

If it is determined that the difference is above the first reference value, the processor 1130 in the light source driver 256 may calculate a second duty which is to be applied to each region, based on the information about the sensed illuminance (S1142).

The processor 1130 of the light source driver 256 may apply a switching control signal having a third duty obtained by adding the first duty and the second duty to each of the switching elements S1 to S6 (S1144).

When the difference in local dimming data, illuminance, or duty between a region corresponding to the fourth light source LS4 and a region corresponding to the fifth light source LS5 is above the first reference value as illustrated in FIG. 9A, the processor 1130 in the light source driver 256 may control driving times of at least some of the switching elements Sa1 to Sa6 to decrease the difference in illuminance between the corresponding regions in order to prevent a halo phenomenon.

Particularly, the processor 1130 may increase driving times of at least some of the switching elements Sa1 to Sa6.

For example, the processor 1130 may increase a second duty to be applied to the fourth switching element corresponding to the fourth light source LS4 and a second duty to be applied to the fifth switching element corresponding to the fifth light source LS5 to decrease the difference in illuminance between the region corresponding to the fourth light source LS4 and the region corresponding to the fifth light source LS5 illustrated in FIG. 9A.

The processor 1130 may set the second duty of the fourth switching element to be greater than the second duty of the fifth switching element, so that the difference in final duty between the fourth switching element and the fifth switching element becomes smaller.

Although the processor 1130 may calculate only the second duties to be applied to the fourth and fifth switching elements Sa4 and Say, it is possible to calculate second duties to be applied to all of the first to sixth switching elements Sa1 to Sa6.

In this case, as a preset duty becomes bigger, the processor 1130 may control an added second duty to become smaller. Thereby, the difference in third duty, which is a final duty, between regions is decreased and the difference in illuminance between regions is also decreased.

In this way, the processor 1130 increases driving times of at least some of the switching elements Sa1 to Sa6 such that the difference in illuminance between corresponding regions becomes small. Therefore, a halo phenomenon caused by the difference in illuminance between adjacent regions is reduced.

Particularly, the processor 1130 in the light source driver 256 increases the driving times of at least some of the switching elements Sa1 to Sa6, as the sensed illuminance decreases. Thereby, the halo phenomenon is prevented according to an ambient illuminance situation.

A flowchart of FIG. 11B is similar to a flowchart of FIG. 11A, except that step S1128 is further performed between steps S1125 and S1130.

That is, the processor 1130 may determine whether an ambient illuminance is less than a second reference value, after performing step S1125 (S1128). If it is determined that the ambient illuminance is less than the second reference value, the processor 1130 may perform step S1130 and subsequent steps.

That is, only when the ambient illuminance is considerably low, the processor may perform step S1130 and subsequent steps in which a driving time or a duty of a switching element corresponding to a region having a probability of generating the halo phenomenon is varied. Thereby, an algorithm of preventing a halo phenomenon can be efficiently applied.

Herein, the second reference value may be approximately 150 nit or less.

FIGS. 12 to 17 are diagrams referred to for explaining the operation of the image display apparatus of FIGS. 10 to 11B.

Figure 12:
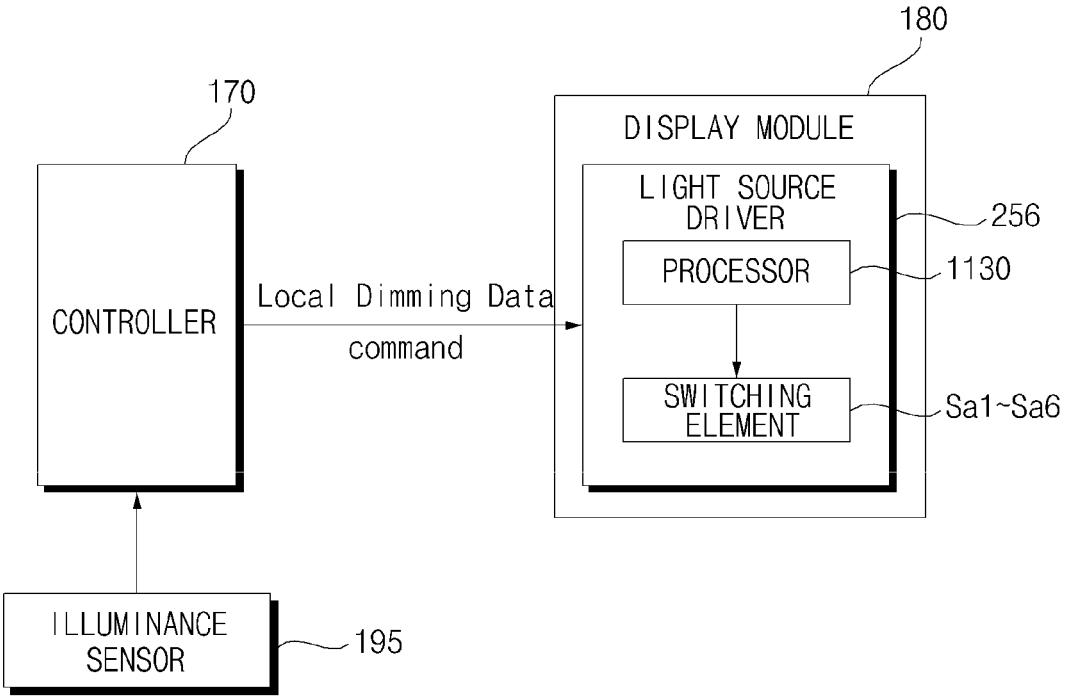
FIGS. 12 to 17 are diagrams referred to for explaining the operation of the image display apparatus of FIGS. 10 to 11B.

FIGS. 12 to 13B illustrate data transmitted between the controller 170 and the display module 180.

Referring to FIG. 12, image data to be displayed may be processed in the controller 170 and then be transmitted to the display module 180. The image data may be transmitted in the form of low voltage differential signaling (LVDS) data or mini LVDS data.

The controller 170 may transmit local dimming data and illuminance information corresponding to a plurality of regions to the display module 180.

Figure 13A:
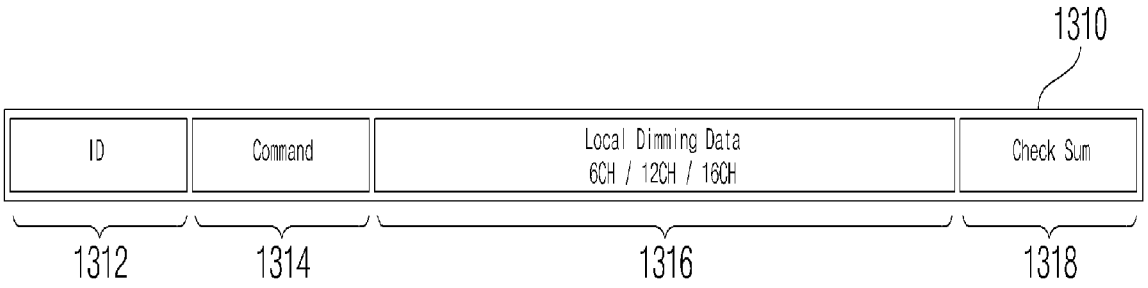

The controller 170 may transmit data 1310 for SPI communication to the display module 180, as illustrated in FIG. 13A.

The data 1310 for SPI communication may include an ID, a command, local dimming data, and a checksum.

The ID may be a start code and the command may be data related to an operation condition of the light source driver 256, such as local dimming or a store mode.

The local dimming data may include illuminance information per region according to an image. The checksum may include a code for confirming whether transmitted information has an error.

To transmit ambient illuminance information, the command in the data 1310 may be used.

For example, if two bits in the command are used, information about four illuminances or gains may be transmitted as illustrated in FIG. 13B.

FIG. 13B illustrates the information about four gains Gain a to Gain d.

The four gains Gain a to Gain d may be reciprocals of respective illuminances.

Figure 14:
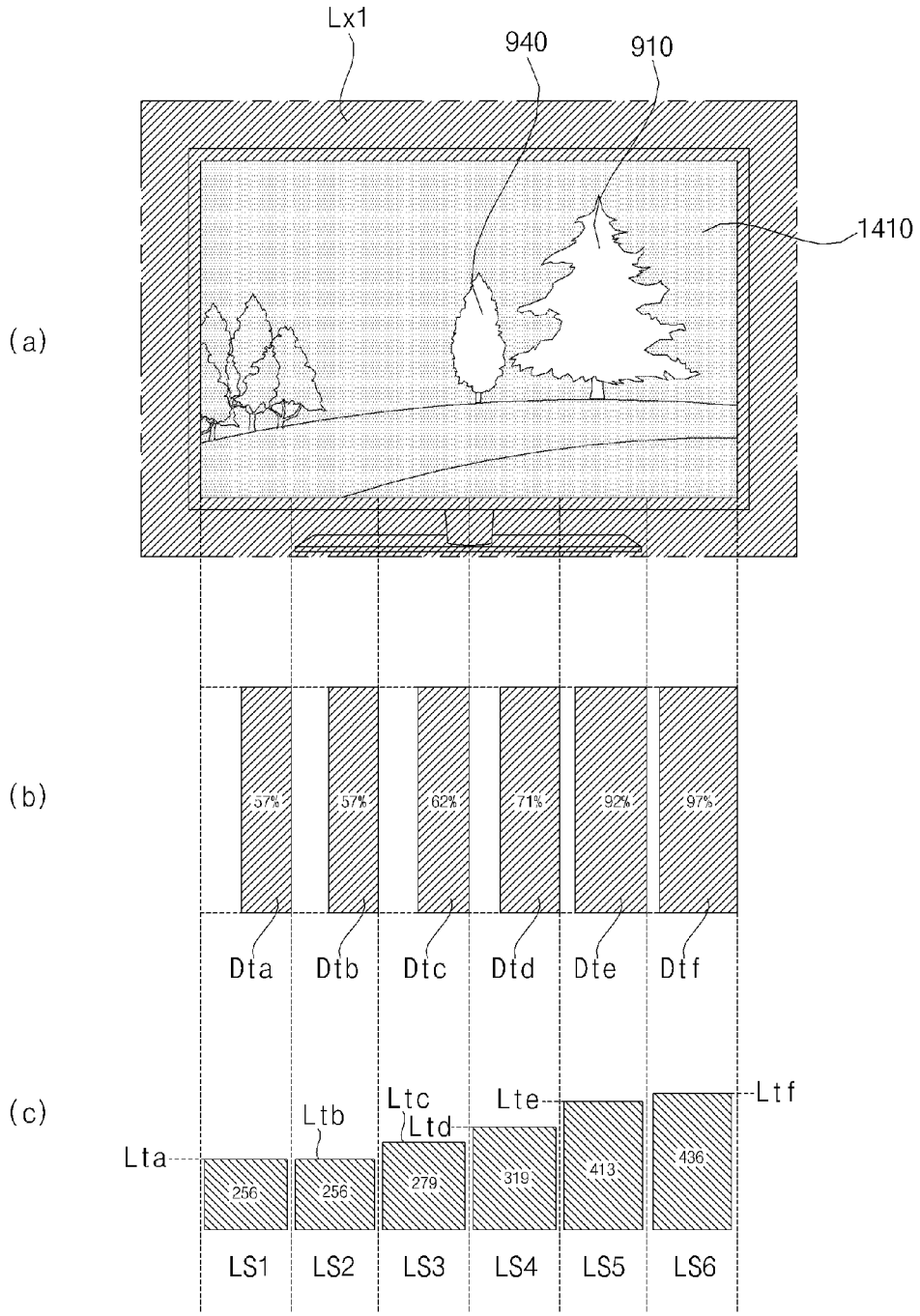

FIG. 14 illustrates a result of complementing a duty when an ambient illuminance is Lx1.

In FIG. 14, (a) illustrates an example of an input image 1410. The input image 1410 is mostly dark but has a bright region in some objects 940 and 910.

To display the input image 1410, in FIG. 9A, duties of switching control signals applied to the switching elements Sa1 to Sa6 for driving the light sources LS1 to LS6 are Dt1 to Dt6, respectively, and illuminances output from the light sources LS1 to LS6 are Lt1 to Lt6, respectively. In this case, the halo phenomenon region 905*a* as illustrated in FIG. 9A occurs.

Then, the processor 1130 may control driving times of at least some of the switching elements Sa1 to Sa6 to decrease the difference in illuminance in order to reduce the halo phenomenon.

For example, the processor 1130 may control the duties of switching control signals applied to the switching elements Sa1 to Sa6 for driving the light sources LS1 to LS6 to Dta to Dtf, respectively, as illustrated in (b) of FIG. 14 and control illuminances output from the light sources LS1 to LS6 to be Lta to Ltf, respectively, as illustrated in (c) of FIG. 14.

Herein, Dta to Dtf may be 57%, 57%, 62%, 71%, 92%, and 97%, respectively, as illustrated in (b) of FIG. 14.

That is, as compared with Dt1 to Dt6 of 34%, 34%, 36%, 44%, 88%, and 97% of FIG. 9A, Dta to Dtf are increased by 23%, 23%, 26%, 27%, 4%, and 0%, respectively.

Particularly, the duty of the switching control signal applied to the fourth light source LS4 having the biggest difference in duty or illuminance with an adjacent light source is increased by 27%, indicating the greatest increase. Thereby, the difference in duty between the fourth region and the fifth region is decreased and a halo phenomenon is prevented.

While, in FIG. 14, duties are increased only with respect to the first to fifth switching elements Sa1 to Sa5 among the first to sixth switching elements Sa1 to Sa6, it is possible to increase a duty even with respect to the sixth switching element Sa6.

Meanwhile, Lta to Ltf may be 256, 256, 279, 319, 413, and 436 nit, respectively, due to variation in duty, as illustrated in (c) of FIG. 14.

That is, as compared with Lt1 to Lt6 of 153, 153, 162, 198, 395, and 436 nit of FIG. 9A, Lta to Ltf are increased by 103, 103, 117, 121, 118, and 0 nit, respectively. Particularly, the illuminance in the fourth light source LS4 having the biggest difference in duty or illuminance with an adjacent light source is increased by 121 nit indicating the greatest increase. Thereby, the difference in duty or illuminance between the fourth region and the fifth region is decreased and a halo phenomenon is prevented.

Figure 15:
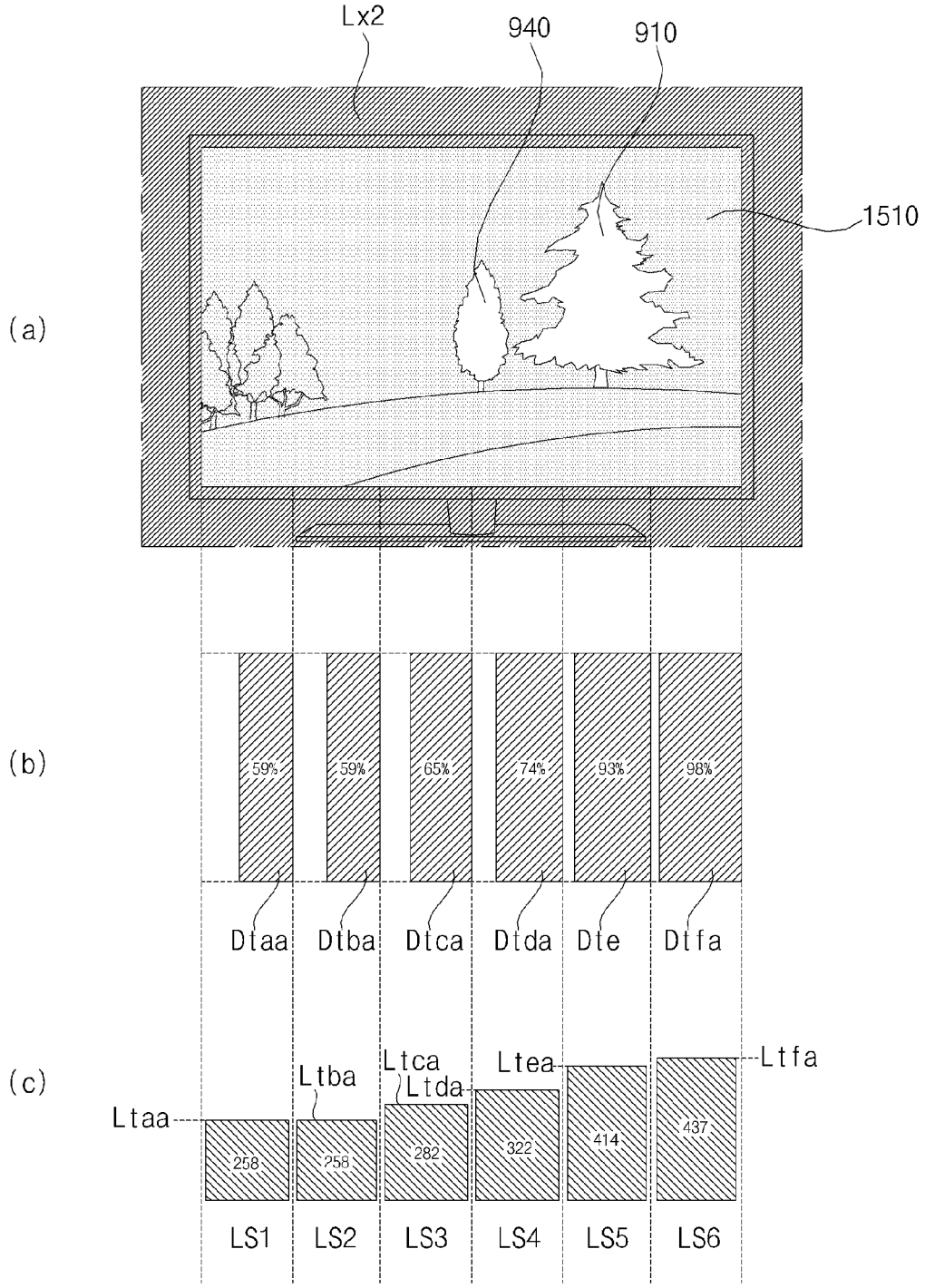

FIG. 15 illustrates a result of complementing a duty when an ambient illuminance is Lx2.

In FIG. 15, (a) illustrates an example of an input image 1510. The input image 1510 is mostly dark but has a bright region in some objects 940 and 910.

To display the input image 1510, in FIG. 9A, the duties of the switching control signals applied to the switching elements Sa1 to Sa6 for driving the light sources LS1 to LS6 are Dt1 to Dt6, respectively, and the illuminances output from the light sources LS1 to LS6 are Lt1 to Lt6, respectively. In this case, the halo phenomenon region 905*a* as illustrated in FIG. 9A occurs.

Then, the processor 1130 may control the driving times of at least some of the switching elements Sa1 to Sa6 to decrease the difference in illuminance in order to reduce the halo phenomenon.

For example, the processor 1130 may control the duties of switching control signals applied to the switching elements Sa1 to Sa6 for driving the light sources LS1 to LS6 to Dtaa to Dtfa, respectively, as illustrated in (b) of FIG. and control the illuminances output from the light sources LS1 to LS6 to be Ltaa to Ltfa, respectively, as illustrated in (c) of FIG. 15.

Herein, Dtaa to Dtfa may be 59%, 59%, 65%, 74%, 93%, and 98%, as illustrated in (b) of FIG. 15.

That is, as compared with Dt1 to Dt6 of 34%, 34%, 36%, 44%, 88%, and 97% of FIG. 9A, Dtaa to Dtfa are increased by 25%, 25%, 29%, 30%, 5%, and 17%, respectively.

Particularly, the duty of the switching control signal applied to the fourth light source LS4 having the biggest difference in duty or illuminance with an adjacent light source is increased by 30% indicating the greatest increase. Thereby, the difference in duty between the fourth region and the fifth region is decreased and the halo phenomenon is prevented.

Meanwhile, since the ambient illuminance Lx2 of FIG. 15 is lower that the ambient illuminance Lx1 of FIG. 14, the duties of the switching control signals applied to the switching elements Sa1 to Sa6 may be further increased by 2%, 2%, 3%, 3%, 1%, and 1%.

Particularly, since the duty of the switching control signal applied to the switching element Sa4 corresponding to the fourth light source LS4 having the biggest difference in duty or illuminance with an adjacent light source is further increased, the difference in duty between the fourth region and the fifth region is decreased although an ambient illuminance decreases. Therefore, the halo phenomenon is prevented.

Meanwhile, Ltaa to Ltfa may be 258, 258, 282, 322, 414, and 437 nit, respectively, due to variation in duty, as illustrated in (c) of FIG. 15.

That is, as compared with Lt1 to Lt6 of 153, 153, 162, 198, 395, and 436 nit of FIG. 9A, Ltaa to Ltfa may be increased by 105, 105, 120, 124, 119, and 1 nit, respectively.

Particularly, the illuminance in the fourth light source LS4 having the biggest difference in duty or illuminance with an adjacent light source is increased by 124 nit indicating the greatest increase. Thereby, the difference in duty or illuminance between the fourth region and the fifth region is decreased and the halo phenomenon is prevented.

Meanwhile, since the ambient illuminance Lx2 of FIG. 15 is lower that the ambient illuminance Lx1 of FIG. 14, the duties or illuminances of the switching control signals applied to the switching elements Sa1 to Sa6 may be further increased by 2, 2, 3, 3, 1, and 1 nit.

Particularly, since the duty of the switching control signal applied to the switching element Sa4 corresponding to the fourth light source LS4 having the biggest difference in duty or illuminance with an adjacent light source is further increased, the difference in duty between the fourth region and the fifth region is decreased although an ambient illuminance decreases. Therefore, the halo phenomenon is prevented.

Figure 16A:
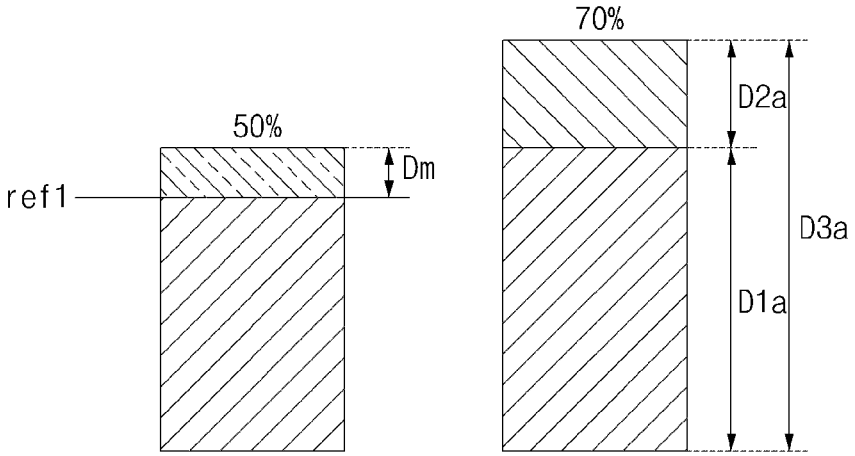
Figure 16B:
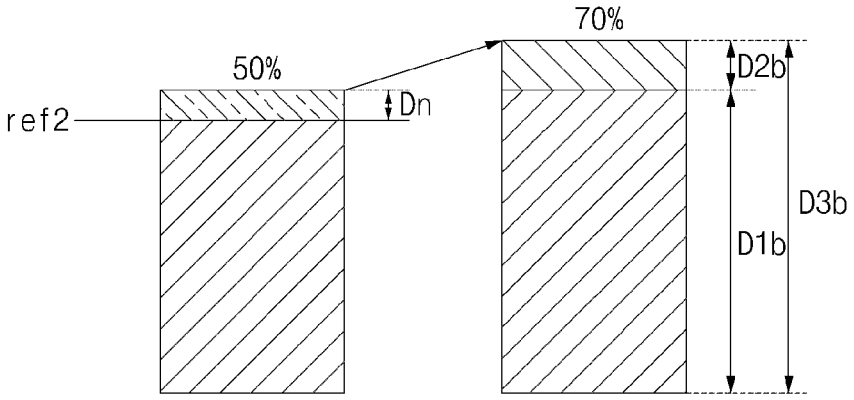

FIG. 16A and FIG. 16B are diagrams illustrating increase in duty according to gain (illuminance information).

Referring to FIG. 16A, duty is increased by D2*a* in correspondence to a part Dm based on a reference duty ref1. Therefore, a final third duty D3*a* may be calculated by adding a first duty D1*a* to a second duty D2*a*.

Referring to FIG. 16B, duty is increased by D2*b* in correspondence to a part Dn based on a reference duty ref2. Therefore, a final third duty D3*b* may be calculated by adding a first duty D1*b* to a second duty D2*b*.

As comparing FIG. 16A with FIG. 16B, FIG. 16A shows that gain is high and FIG. 16B shows that gain is low.

As described with reference to FIG. 13B, since ambient illuminance is inversely proportional to gain, in FIG. 6A having a higher gain, i.e., a lower ambient illuminance, the second duty D2*a* is set to be higher than the second duty D2*b* of FIG. 16B.

Thus, light sources for preventing the halo phenomenon can be driven according to ambient illuminance.

Figure 17:
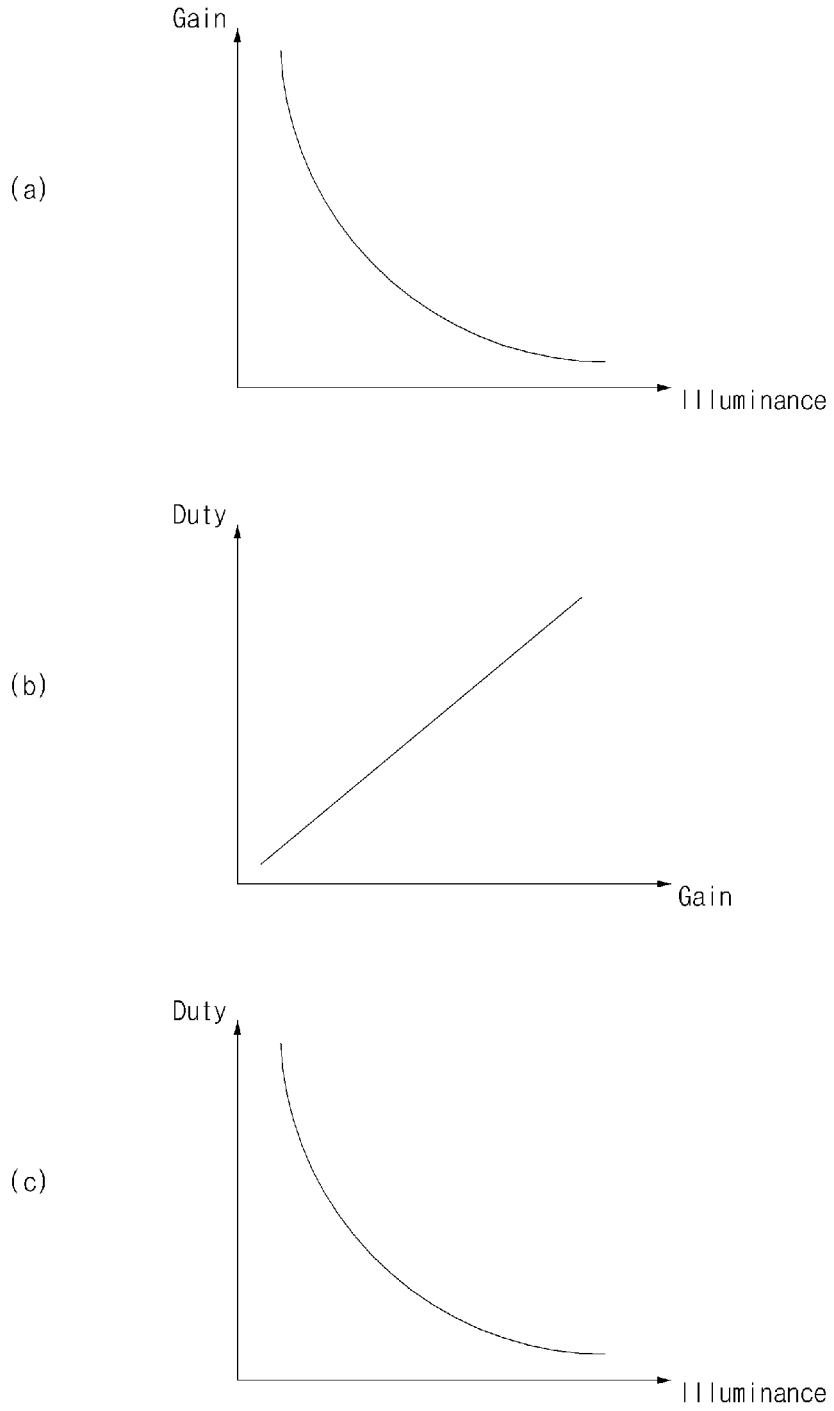

The relationship between illuminance and gain, gain and duty, and illuminance and duty may be summarized with reference to FIG. 17.

As illustrated in (a) of FIG. 17, illuminance is inversely proportional to gain.

The processor 1130 may set the duty to be proportional to the gain, based on gain information of FIG. 13B received from the controller 170. That is, as the gain becomes higher, the duty may be set to be increased.

The processor 1130 may set the duty to be increased as an ambient illuminance decreases, as illustrated in (c) of FIG. 17.

Meanwhile, the processor 1130 may receive illuminance information, rather than gain information, from the controller 170. In this case, the duty may be set to be increased as the ambient illuminance become lower, as illustrated in (c) of FIG. 17. Accordingly, light sources can be driven at a set duty according to the ambient illuminance. As a result, the halo phenomenon can be reduced.

As is apparent from the above description, an image display apparatus according to an embodiment of the present invention includes a display panel, an illuminance sensor to sense ambient illuminance of the display panel, a plurality of light sources disposed in an edge region of a back surface of the display panel to output light, a plurality of switching elements to switch the light sources, and a processor to control the switching elements. When a difference in local dimming data of an input image between adjacent first and second regions is above a first reference value, the processor controls driving times of at least some of the switching elements to decrease a difference in illuminance between the first region and the second region, based on the illuminance sensed by the illuminance sensor, thereby reducing a halo phenomenon.

Particularly, the halo phenomenon generated between the first region and the second region can be reduced.

Particularly, the halo phenomenon can be reduced while an image of a high dynamic range is displayed.

When the difference in local dimming data of an input image between the first and second regions is above the first reference value and when the illuminance sensed by the illuminance sensor is less than a second reference value, the processor controls the driving times of the at least some of the switching elements to decrease the difference in illuminance between the first region and the second region, based on the sensed illuminance, thereby reducing the halo phenomenon which frequently occurs in a low illuminance state.

The processor controls the driving times of the at least some of the switching elements to be increased, as the sensed illuminance decreases, thereby properly reducing the halo phenomenon in displaying images.

The processor controls duties of switching control signals applied to the switching elements to be increased, as the sensed illuminance decreases, thereby reducing a halo phenomenon in displaying images.

Meanwhile, an image display apparatus according to another embodiment of the present invention includes a display panel, an illuminance sensor to sense an ambient illuminance of the display panel, a plurality of light sources disposed in an edge region of a back surface of the display panel to output light, and a processor to control the light sources, wherein the processor controls driving times of the light sources to be variable, based on the sensed illuminance, thereby reducing a halo phenomenon in displaying images.

Meanwhile, an image display apparatus according to a further embodiment of the present invention includes a display panel, an illuminance sensor to sense an ambient illuminance of the display panel, a plurality of light sources disposed in an edge region of a back surface of the display panel to output light, and a processor to control the light sources, wherein, when a difference in local dimming data of an input image between adjacent first and second regions is above a first reference value, the processor controls driving times of at least some of the light sources to decrease a difference in illuminance between the first region and the second region, based on the illuminance sensed by the illuminance sensor, thereby reducing a halo phenomenon in displaying images.

Meanwhile, an operation method of the image display apparatus according to the present invention may be implemented as processor-readable code that can be written in a recording medium readable by a processor included in the image display apparatus. The processor-readable recording medium includes any type of recording device in which processor-readable data is stored. Examples of the processor-readable recording medium include a ROM, a RAM, a CD-ROM, a magnetic tape, a floppy disk, an optical data storage device, and a carrier wave such as data transmission over the Internet. The processor-readable recording medium can be distributed over computer systems connected to a network so that processor-readable code is stored therein and executed therefrom in a decentralized manner.

While the present invention has been particularly shown and described with reference to exemplary embodiments thereof, it will be understood by those of ordinary skill in the art that various changes in form and detail may be made herein without departing from the spirit and scope of the present invention as defined by the following claims and such modifications and variations should not be understood individually from the technical idea or aspect of the present invention.

What is claimed is:

1. An image display apparatus, comprising:

a display panel to display an input image;

an illuminance sensor to sense an ambient illuminance of the display panel;

a plurality of light sources disposed in an edge region of a back surface of the display panel to output light;

a plurality of switching elements to switch the light sources; and a processor to control the switching elements, wherein the input image includes a first region, a second region, and a third region, wherein the first region is positioned between the third region and second region, wherein, when a difference in local dimming data of the input image between adjacent first and second regions is above a first reference value and a difference in local dimming data of the input image between adjacent third and first regions is equal to or less than the first reference value, the processor controls driving times of at least some of the switching elements to decrease a difference in illuminance between the first region and the second region, based on the illuminance sensed by the illuminance sensor, wherein, when a first local dimming data of the first region is smaller than a second local dimming data of the second region, the first local dimming data is greater than a third local dimming data of the third region, and a difference between the first local dimming data and the second local dimming data is greater than a difference between the third local dimming data and the first local dimming data, the processor increases a driving time of a first switching element corresponding to the first area among the plurality of switching elements to be greater than an increase in driving time of a second switching element corresponding to the second region among the plurality of switching elements and an increase in driving time of a third switching element corresponding to the third region among the plurality of switching elements, the increase in driving time of the second switching element being less than the increase in driving time of the third switching element, and wherein the processor is configured to:

calculate first duties of switching control signals applied to the switching elements, based on the local dimming data, wherein the difference in the local dimming data of the input image between the adjacent first and second regions is above the first reference value, calculate second duties to decrease the difference in illumination between the first region and the second regions, based on the illuminance sensed by the illuminance sensor, and apply switching control signals corresponding to third duties obtained by adding the first duties and second duties to the switching elements.

2. The image display apparatus according to claim 1, wherein, when the difference in the local dimming data of the input image between the adjacent first and second regions is above the first reference value, the processor controls driving times of the first switching element and the second switching element respectively corresponding to the first region and the second region to decrease the difference in illuminance between the first region and the second region, based on the illuminance sensed by the illuminance sensor.

3. The image display apparatus according to claim 1, wherein, when the difference in the local dimming data of the input image between the adjacent first and second regions is above the first reference value, the processor controls the driving times of the at least some of the switching elements to be increased, as the sensed illuminance decreases.

4. The image display apparatus according to claim 1, wherein, when the difference in the local dimming data of the input image between the adjacent first and second regions is above the first reference value, the processor controls driving times of the first switching element and the second switching element respectively corresponding to the first region and the second region to be increased, as the sensed illuminance decreases.

5. The image display apparatus according to claim 1, wherein, when the difference in the local dimming data of the input image between the adjacent first and second regions is above the first reference value and when the illuminance sensed by the illuminance sensor is less than a second reference value, the processor controls the driving times of the at least some of the switching elements to decrease the difference in illuminance between the first region and the second region, based on the sensed illuminance.

6. The image display apparatus according to claim 1, further comprising:

a controller to calculate local dimming data of the input image per region.

7. The image display apparatus according to claim 6, wherein, the processor controls second duties of the first switching element and the second switching element respectively corresponding to the first region and the second region to be greater than second duties of the other the switching elements.

8. The image display apparatus according to claim 6, wherein the processor controls the second duties to be increased, as the sensed illuminance decreases.

9. The image display apparatus according to claim 6, wherein the controller transmits the local dimming data and information about the illuminance sensed by the illuminance sensor to the processor.

10. The image display apparatus according to claim 1, wherein, when the difference in the local dimming data of the input image between the adjacent first and second regions is above the first reference value, the processor controls a difference in illuminance between light sources corresponding to the first region and the second region among the light sources to be less than a difference in illuminance or local dimming data of the input image between the first region and the second region.

11. The image display apparatus according to claim 1, wherein peak values of currents flowing into the light sources are the same.

12. An image display apparatus, comprising:

a display panel to display an input image;

an illuminance sensor to sense an ambient illuminance of the display panel;

a plurality of light sources disposed in an edge region of a back surface of the display panel to output light; and a processor to control the light sources, wherein the input image includes a first region, a second region, and a third region, wherein the first region is positioned between the third region and second region, wherein the processor controls driving times of the light sources to be variable, based on the sensed illuminance, wherein, when a first local dimming data of a first region is smaller than a second local dimming data of a second region and a difference between the first local dimming data and the second local dimming data is greater than a difference between the third local dimming data and the first local dimming data, the processor increases a driving time of a first light source corresponding to the first area among the light sources to be greater than an increase in driving time of a second light source corresponding to the second region among the light sources and an increase in driving time of a third light source corresponding to the third region among the light sources, and the increase in driving time of the second light source being less than the increase in driving time of the third light source, wherein the processor controls the driving time of the first light source to increase as the sensed illuminance decreases and wherein the processor is configured to:

calculate first duties of the first light source, the second light source, and the third light source, based on the local dimming data, when the difference in the local dimming data of the input image between the adjacent first and second regions is above the first reference value, calculate second duties to decrease the difference in illuminance between the first region and the second region, based on the illuminance sensed by the illuminance sensor, and calculate third duties by adding the first duties and the second duties to each of the first light source, the second light source, and the third light source, respectively.

13. The image display apparatus according to claim 12, wherein the processor controls the driving times of the light sources to increase as the sensed illuminance decreases.

14. The image display apparatus according to claim 12, wherein, when a difference in the local dimming data of the input image between adjacent first and second regions is above a first reference value, the processor controls driving times of at least some of the light sources to decrease a difference in illuminance between the first region and the second region, based on the illuminance sensed by the illuminance sensor.

15. The image display apparatus according to claim 14, wherein, when the difference in the local dimming data of the input image between the adjacent first and second regions is above the first reference value and when the illuminance sensed by the illuminance sensor is less than a second reference value, the processor controls the driving times of the at least some of the light sources to decrease the difference in illuminance between the first region and the second region, based on the sensed illuminance.

16. The image display apparatus according to claim 12, wherein peak values of currents flowing into the light sources are the same.

17. An image display apparatus, comprising:

a display panel to display an input image;

an illuminance sensor to sense an ambient illuminance of the display panel;

a plurality of light sources disposed in an edge region of a back surface of the display panel to output light; and a processor to control the light sources, wherein the input image includes a first region, a second region, and a third region, wherein the first region is positioned between the third region and second region, wherein, when a difference in local dimming data of the input image between adjacent first and second regions is above a first reference value and a difference in local dimming data of the input image between adjacent third and first regions is equal to or less than the first reference value, the processor controls driving times of at least some of the light sources to decrease a difference in illuminance between the first region and the second region, based on the illuminance sensed by the illuminance sensor, wherein when a first local dimming data of the first region is smaller than a second local dimming data of the second region, the first local dimming data is greater than a third local dimming data of the third region, and a difference between the first local dimming data and the second local dimming data is greater than a difference between the third local dimming data and the first local dimming data, the processor increases driving time of a first light source corresponding to the first area among the light sources to be greater than an increase in driving time of a second light source corresponding to the second region among the light sources and an increase in driving time of a third light source corresponding to the third region among the light sources, and the increase in driving time of the second light source being is less than the increase in driving time of the third light and wherein the processor is configured to:

calculate first duties of the first light source, the second light source, and the third light source, based on the local dimming data, when the difference in the local dimming data of the input image between the adjacent first and second regions is above the first reference value, calculate second duties to decrease the difference in illuminance between the first region and the second region, based on the illuminance sensed by the illuminance sensor, and calculate third duties by adding the first duties and the second duties to each of the first light source, the second light source, and the third light source, respectively.

18. The image display apparatus according to claim 17, wherein the processor controls the driving times of the light sources to be increased, as the sensed illuminance decreases.

19. The image display apparatus according to claim 17, wherein peak values of currents flowing into the light sources are the same.

* * * * *